US011149431B1

(12) United States Patent
Meznarich

(10) Patent No.: US 11,149,431 B1
(45) Date of Patent: Oct. 19, 2021

(54) ADJUSTABLE BRACKETS FOR INSTALLING BUILDING ATTACHMENTS

(71) Applicant: Russ Edward Meznarich, Paso Robles, CA (US)

(72) Inventor: Russ Edward Meznarich, Paso Robles, CA (US)

( * ) Notice: Subject to any disclaimer, the term of this patent is extended or adjusted under 35 U.S.C. 154(b) by 0 days.

(21) Appl. No.: 16/688,581

(22) Filed: Nov. 19, 2019

Related U.S. Application Data

(60) Provisional application No. 62/769,439, filed on Nov. 19, 2018.

(51) Int. Cl.
*E04B 1/41* (2006.01)
*E04B 1/00* (2006.01)
*E04B 1/38* (2006.01)

(52) U.S. Cl.
CPC ..... *E04B 1/40* (2013.01); *E04B 1/003* (2013.01); *E04B 2001/405* (2013.01)

(58) Field of Classification Search
CPC ..... E04B 1/40; E04B 1/003; E04B 2001/405
See application file for complete search history.

(56) References Cited

U.S. PATENT DOCUMENTS 1,241,827 A 10/1917 Davis
1,787,167 A * 12/1930 Purdy ..... E04B 1/2604 403/58

(Continued)

FOREIGN PATENT DOCUMENTS

JP 10212762 8/1998
KR 01670346 11/2016

OTHER PUBLICATIONS

"Heavy Duty Fascia Bracket Gal", http://store.demak.com.au/heavy-duty-fascia-bracket-gal-various-angles/, Mar. 27, 2015.

(Continued)

*Primary Examiner* — Rodney Mintz
(74) *Attorney, Agent, or Firm* — Peacock Law P.C.; Philip D. Askenazy

(57) ABSTRACT

Roof brackets for attaching a structure such as a patio cover to a building, and methods for installing the brackets. The brackets have a saddle for receiving a support beam of the structure. The brackets can be attached to the building roof, but do not penetrate the roof substrate, thus preventing leakage and other structural problems. The roof brackets comprise a plate that is installed between the roof substrate and the shingles or tile on the roof. The brackets are available in different configurations compatible with standard roof pitches for easy installation. One roof bracket has a riser so that the saddle is lifted above the roof. Another roof bracket is configured so that when installed the saddle is located beyond the edge of the roof. Other brackets can be attached to the rafters under the roof, are available in different configurations depending on standard roof pitch, and they are configured to extend below and outward from the fascia. Any of these brackets are available in versions which are adjustable by the installer to provide a level saddle even in situations where the roof does not have a standard pitch, whether by design or due to inaccurate installation.

9 Claims, 30 Drawing Sheets

(56) References Cited

U.S. PATENT DOCUMENTS 2,497,337 A * 2/1950 Ackerman ..... E04F 10/08 16/259
2,629,906 A * 2/1953 Holmes ..... E04B 1/2604 403/73
3,184,800 A 5/1965 Nelson
3,749,428 A * 7/1973 Hustead ..... F16B 7/04 403/91
4,229,919 A 10/1980 Hughes
4,333,289 A 6/1982 Strickland
4,340,100 A 7/1982 Anderson, II
4,381,635 A * 5/1983 Solo ..... E04B 1/2608 52/639
4,387,543 A 6/1983 Tschan et al.
4,449,335 A * 5/1984 Fahey ..... E04B 1/2608 52/713
4,560,301 A 12/1985 Gilf
5,004,369 A 4/1991 Young
5,056,750 A 10/1991 Ellithorpe
5,190,268 A 3/1993 Espinueva
5,228,667 A 7/1993 Bridegum
5,230,198 A 7/1993 Callies
5,375,384 A 12/1994 Wolfson
5,380,116 A 1/1995 Colonias
5,456,441 A 10/1995 Callies
D368,647 S 4/1996 Koebbe
5,561,950 A 10/1996 Collins et al.
5,603,187 A 2/1997 Merrin et al.
5,788,204 A * 8/1998 Goodwin ..... E04G 3/26 248/357
5,797,694 A 8/1998 Breivik
5,857,295 A * 1/1999 Mikawa ..... E04B 7/045 52/656.9
6,070,368 A 6/2000 Anderson
6,820,868 B1 11/2004 Reymus
7,285,006 B1 10/2007 Daily et al.
7,575,213 B2 8/2009 Rausch
D607,711 S 1/2010 Adams et al.
7,891,144 B2 * 2/2011 Gilstrap ..... E04B 7/045 52/92.2
7,918,054 B2 * 4/2011 Grafton ..... E04D 3/3608 52/92.3
8,938,932 B1 1/2015 Wentworth et al.
9,139,999 B2 * 9/2015 Nicholls ..... E04B 1/2612
9,175,472 B1 * 11/2015 Calini ..... E04B 1/40
9,347,231 B2 5/2016 Cormier et al.
9,388,563 B1 * 7/2016 Calini ..... E04C 3/17
9,705,447 B2 7/2017 Cavieres et al.
9,809,974 B1 11/2017 Brekke
9,822,524 B1 11/2017 Meznarich
10,246,876 B2 * 4/2019 Brean ..... E04F 10/005
10,253,495 B1 * 4/2019 Calini ..... E04B 7/045
10,284,137 B2 5/2019 Meznarich
10,465,389 B2 * 11/2019 Hughes ..... E04B 1/003
2005/0122016 A1 6/2005 Behroozi
2007/0017741 A1 1/2007 Martinez et al.
2007/0090232 A1 4/2007 Cantis et al.
2007/0145222 A1 6/2007 Rausch
2008/0121273 A1 5/2008 Plaisted et al.
2009/0090082 A1 4/2009 Kawai et al.
2009/0211177 A1 * 8/2009 Grafton ..... E04D 3/3608 52/93.1
2012/0272608 A1 11/2012 Groenesteyn
2013/0212955 A1 8/2013 Lethin
2014/0109492 A1 4/2014 Lethin
2014/0182218 A1 7/2014 O'Donnell
2014/0318073 A1 10/2014 Sidhu
2015/0284952 A1 * 10/2015 Hilliaho ..... E04D 3/08 52/11
2016/0040430 A1 2/2016 Lethin
2017/0306612 A1 10/2017 Kasprzak et al.
2018/0073240 A1 * 3/2018 Meznarich ..... E04D 13/12
2018/0334801 A1 * 11/2018 Brean ..... E04B 7/045
2019/0093366 A1 * 3/2019 Hughes ..... E04F 10/08
2019/0285224 A1 * 9/2019 McKechnie ..... E04B 9/127
2020/0291643 A1 * 9/2020 Marlow ..... E04B 1/40

OTHER PUBLICATIONS

"Roof Extenda Pergola Bracket", https://buybuildingsupplies.com.au/roof-extenda-pergola-bracket-box-p-27436.html, Mar. 1, 2016.
"Skylift Roof Riser", http://www.premiumbraziliandecking.com/skylift-roof-riser.html, Jan. 26, 2015.

* cited by examiner

ADJUSTABLE BRACKETS FOR INSTALLING BUILDING ATTACHMENTS

CROSS-REFERENCE TO RELATED APPLICATIONS

This application claims priority to and the benefit of filing of U.S. Provisional Patent Application Ser. No. 62/769,439, entitled "Brackets for Installing Building Attachments", filed on Nov. 19, 2018. The specification and claims thereof are incorporated herein by reference.

BACKGROUND OF THE INVENTION

Field of the Invention (Technical Field)

The present invention relates to brackets for attaching patio covers or other structures or attachments to a house or other building.

BACKGROUND ART

Note that the following discussion may refer to a number of publications and references. Discussion of such publications herein is given for more complete background of the scientific principles and is not to be construed as an admission that such publications are prior art for patentability determination purposes.

A patio cover, such as the one shown in FIG. 1, is typically attached to the roof or wall of a house or other building. The most common method of attaching the support beam to the house is via standard "L" brackets, shown in FIG. 2, which have many disadvantages. They must be bent to match the roof pitch on site, they are weak, unsightly and are needed at 24" on center connections. They also are typically attached to the building's wall or fascia, which affects appearance and requires the removal of existing rain gutters.

SUMMARY OF THE INVENTION (DISCLOSURE OF THE INVENTION)

An embodiment of the present invention is a bracket for attaching a structure to a roof of a building, the bracket comprising a plate sufficiently flat for the plate to be disposed between a roof substrate and a roof covering; and a saddle for receiving a support beam to support the structure; wherein the angle between the plate and the saddle is configured for a particular roof pitch, so that when the flat plate is attached to the roof an opening of the saddle is substantially vertically oriented; and wherein the bracket does not comprise a component for penetrating the roof substrate. The structure preferably comprises a patio cover, an architectural feature, a solar panel, a roof deck, a trellis, an arbor, or a walkway. The roof covering optionally comprises shingles or tiles. The bracket optionally further comprises a vertical riser separating the plate and the saddle, the riser configured to extend upward through the roof covering. Alternatively the saddle can be located at an end of the plate so that when the plate is attached to the roof the saddle is disposed beyond an edge of the roof, and the saddle is preferably disposed above a roof gutter. In this embodiment the bottom of the saddle is preferably attached to an end portion of the plate that is bent at the roof pitch angle with respect to the remaining portion of the plate. The bracket is preferably sufficiently load bearing so that only one bracket is needed along every eight feet of the support beam.

Another embodiment of the present invention is a bracket for attaching a structure to a building, the bracket comprising a first portion configured to attach the bracket to the side of a rafter so that when the first portion is attached to the rafter a top edge of the first portion is disposed against the underside of the roof substrate; a second vertical portion comprising an angle with respect to the first portion, the angle configured for a particular roof pitch, the second vertical portion sufficiently high to extend below a bottom edge of a fascia when the first portion is attached to the rafter; a third horizontal portion sufficiently long to extend beyond a width of the fascia; and a saddle for receiving a support beam to support the structure. The structure preferably comprises a patio cover, an architectural feature, a solar panel, a roof deck, a trellis, an arbor, or a walkway. When the first portion is attached to the rafter the forward edge of the second vertical portion is preferably disposed against the rear face of the fascia. The bracket is preferably sufficiently load bearing so that only one bracket is needed along every eight feet of the support beam.

Another embodiment of the present invention is a bracket assembly for attaching a structure to a roof of a building, the bracket assembly comprising a base component comprising a flat plate configured to be disposed between a roof substrate and a roof covering; and a saddle component comprising a saddle opening for receiving a support beam above the roof substrate to support the structure, the saddle component rotatably attachable to the plate portion; wherein an angle between the base component and the saddle component can be selected so that when the flat plate is attached to the roof the saddle opening is substantially vertically oriented. The base component preferably does not comprise a component for penetrating the roof substrate. The structure typically comprises a patio cover, an architectural feature, a solar panel, a roof deck, a trellis, an arbor, or a walkway. The roof covering typically comprises shingles or tiles. The base component preferably comprises a first connection extension perpendicular to the flat plate configured to extend upward through the roof covering. The saddle component preferably comprises a second connection extension rotatably attachable to the first connection extension. The saddle component alternatively optionally comprises two separate saddle halves, each half comprising a third connection extension and a bend, so that when the third connection extensions of the two saddle halves are attached to opposite sides of the first connection extension, the two saddle halves form the saddle opening. The bracket assembly is preferably sufficiently load bearing so that only one bracket is needed along every eight feet of the support beam. The saddle component is optionally attachable at an end of the base component so that when the flat plate is attached to the roof the saddle component is disposed beyond an edge of the roof. The flat plate is then optionally attached to the roof the saddle component is disposed above a roof gutter. The saddle component and the base component are each preferably formed from a single metallic plate or sheet.

Another embodiment of the present invention is a bracket assembly for attaching a structure to a building, the bracket assembly comprising a rafter component configured to attach the bracket assembly to a side of a rafter; an L component rotatably attachable to the rafter component, the L component comprising a vertical portion sufficiently high to extend vertically below a bottom edge of a fascia when the vertical portion is attached to the rafter component and the rafter component is attached to the rafter, and a horizontal portion sufficiently long to extend beyond a width of the fascia; a saddle extension slideably connectable to the horizontal portion, and a saddle comprising a saddle opening for receiving a support beam to support the structure; wherein an angle between the rafter component and the vertical portion of the L component can be selected so that when the rafter component is attached to the rafter the saddle opening is substantially vertically oriented. When he vertical portion of the L component is attached to the rafter component and the rafter component is attached to the rafter, a forward edge of the vertical portion is preferably disposed against a rear face of the fascia. When the rafter component is attached to the rafter the top edge of the rafter component is preferably disposed against an underside of a roof substrate. The structure typically comprises a patio cover, an architectural feature, a solar panel, a roof deck, a trellis, an arbor, or a walkway. The bracket assembly is preferably sufficiently load bearing so that only one bracket is needed along every eight feet of the support beam. The saddle is optionally rotatably attached to the saddle extension, or alternatively is integrally formed together with the saddle extension, in which case the saddle extension including the saddle is preferably formed from a single metallic plate or sheet. Preferably the saddle extension, the horizontal portion of the L component, or both comprise a horizontal groove.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate the practice of embodiments of the present invention and, together with the description, serve to explain the principles of the invention. The drawings are only for the purpose of illustrating certain embodiments of the invention and are not to be construed as limiting the invention. In the drawings.

DETAILED DESCRIPTION OF EMBODIMENTS OF THE INVENTION

Figure 1:
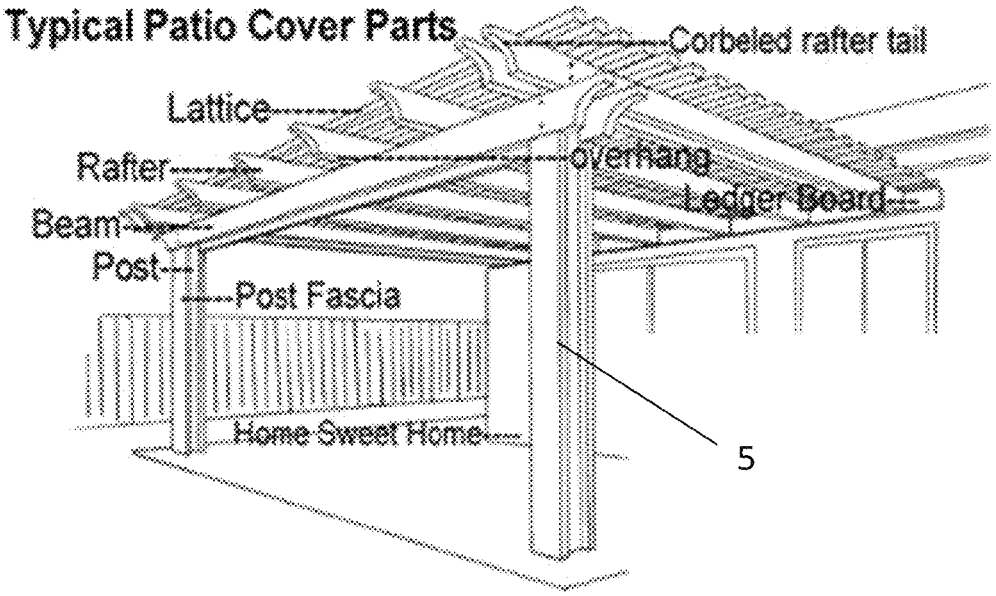
PRIOR ART FIG. 1
FIG. 1 shows a typical patio cover attached to a house.
Figure 2:
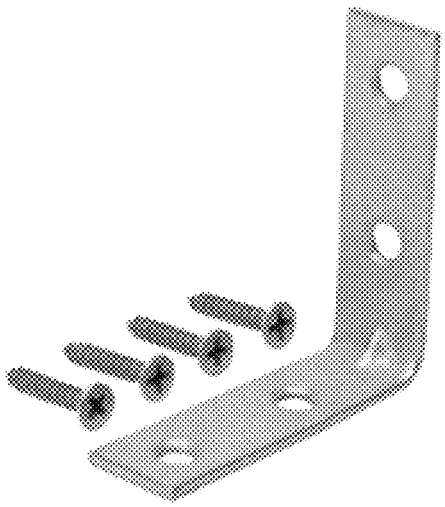
PRIOR ART FIG. 2
FIG. 2 shows a standard "L" bracket.

Embodiments of the present invention are brackets to install a lattice or solid patio cover by attaching it to an existing building without requiring attachment to the building wall or fascia. The brackets are preferably either roof mounted brackets or rafter (under-mount) brackets. Unlike typical roof brackets, the brackets of the present invention do not have to be mounted through the roof; they can be mounted under shingles or tiles without penetrating the roof itself. The brackets preferably comprise powder coated steel and are preferably available in all standard roof pitches. By ensuring consistent pitch angles, a patio cover is true and level and conforms to building codes for rainwater drainage. The powder coating preferably matches the color of the patio cover and/or rafter. The brackets are preferably structurally strong enough so that only one bracket per support post 5 as shown in FIG. 1 is required, per engineering standards. Support posts 5 are typically spaced at least eight feet apart. For existing brackets, one typically needs to be installed every 24" on the building, but brackets of the present invention are preferably sufficiently load bearing so that one needs to be mounted only every eight feet (or more). The present invention thus requires far fewer brackets to support a given load, and because the brackets are much easier to install, installation time is greatly reduced. The present brackets are preferably sufficiently strong to support weight bearing loads heavier than those of patio covers, for example loads due to structures such as wood or metal architectural features, solar panels, roof decks, trellis, arbors, walkways, and the like. It is not necessary to remove existing rain gutters to install the present brackets. The present brackets provide added height under the patio cover, providing adequate slope for drainage while preserving views and enabling the use of hanging accessories such as ceiling fans. Brackets of the present invention are typically less obtrusive than typical "L" brackets, and are more resistant to seismic events.

Roof brackets of the present invention preferably comprise two steel components, a base plate and a saddle (or beam seat), that are preferably welded together, although any material may be used. The base plate for the roof mount bracket is preferably formed from ¼"×3" flatbar and comprises an optional riser and a roof mounted plate. The base plate for the rafter or under-mount bracket is preferably water jet cut from ¼" steel plate to the desired pitch, including the mounting holes. The saddle is preferably manufactured by forming a piece of 3/16"×3" steel flat bar into "U" shape that will accommodate a typical patio cover support beam. The two pieces are then preferably welded with a typical ¼" fillet weld. The bracket is then preferably sandblasted, primed with a zinc based primer, and then powder coated to the desired color. Alternatively the entire bracket may comprise a single molded or cast piece.

Figure 3:
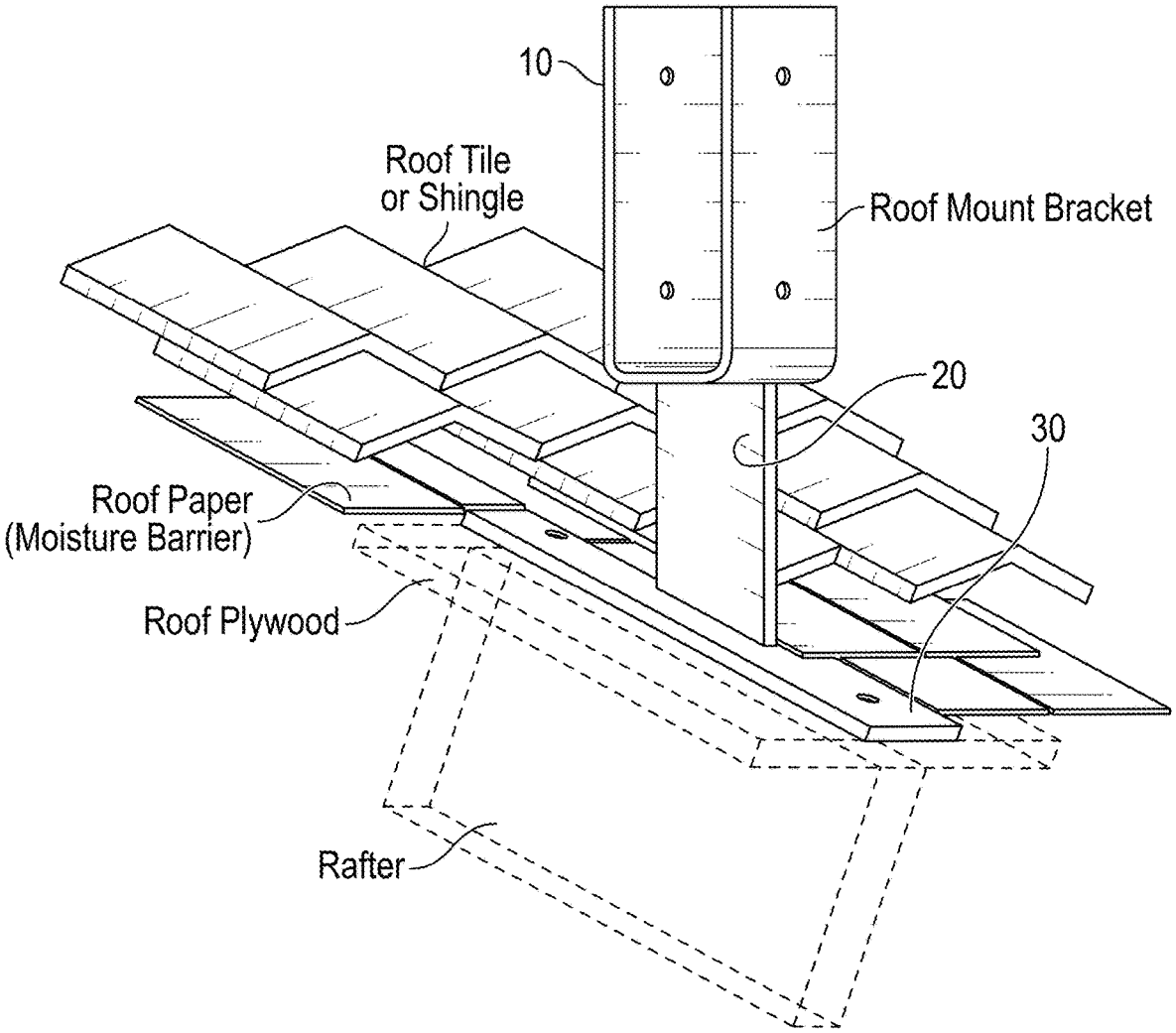
FIG. 3 is a drawing of a high roof mount bracket of the present invention.
Figure 4:
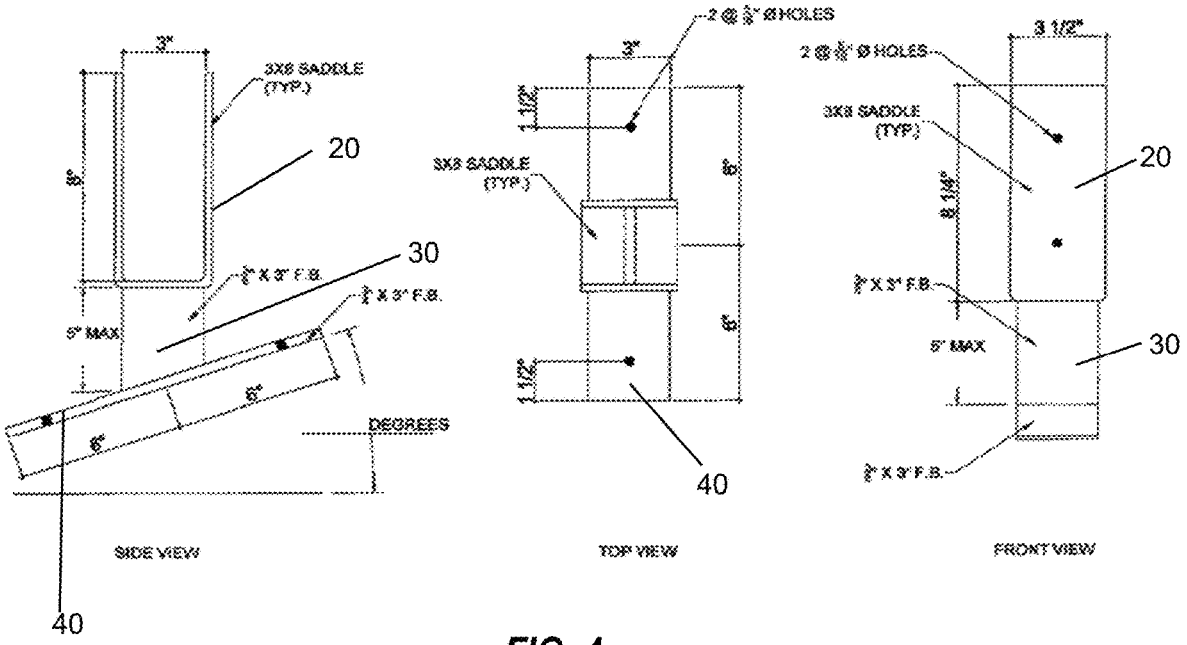
FIG. 4 shows engineering drawings of the high roof mounted bracket of FIG. 3.
Figure 5:
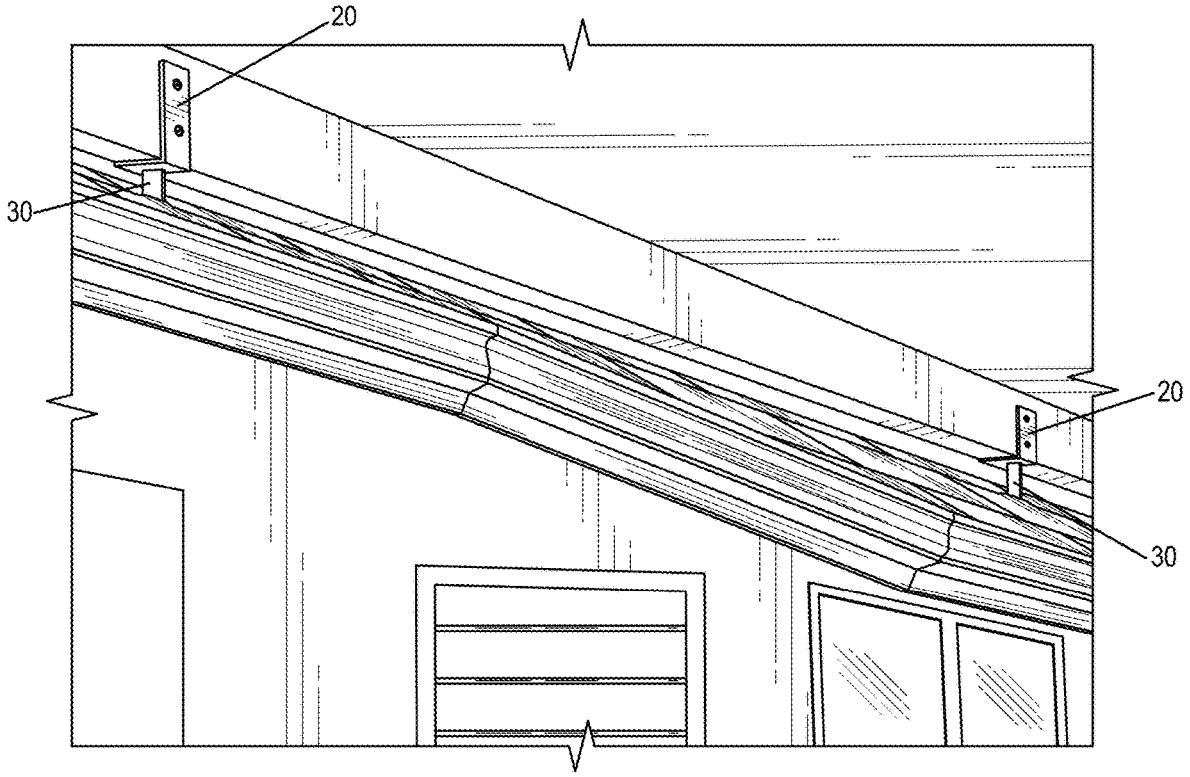
FIG. 5 shows high roof mounted brackets as installed
Figure 6:
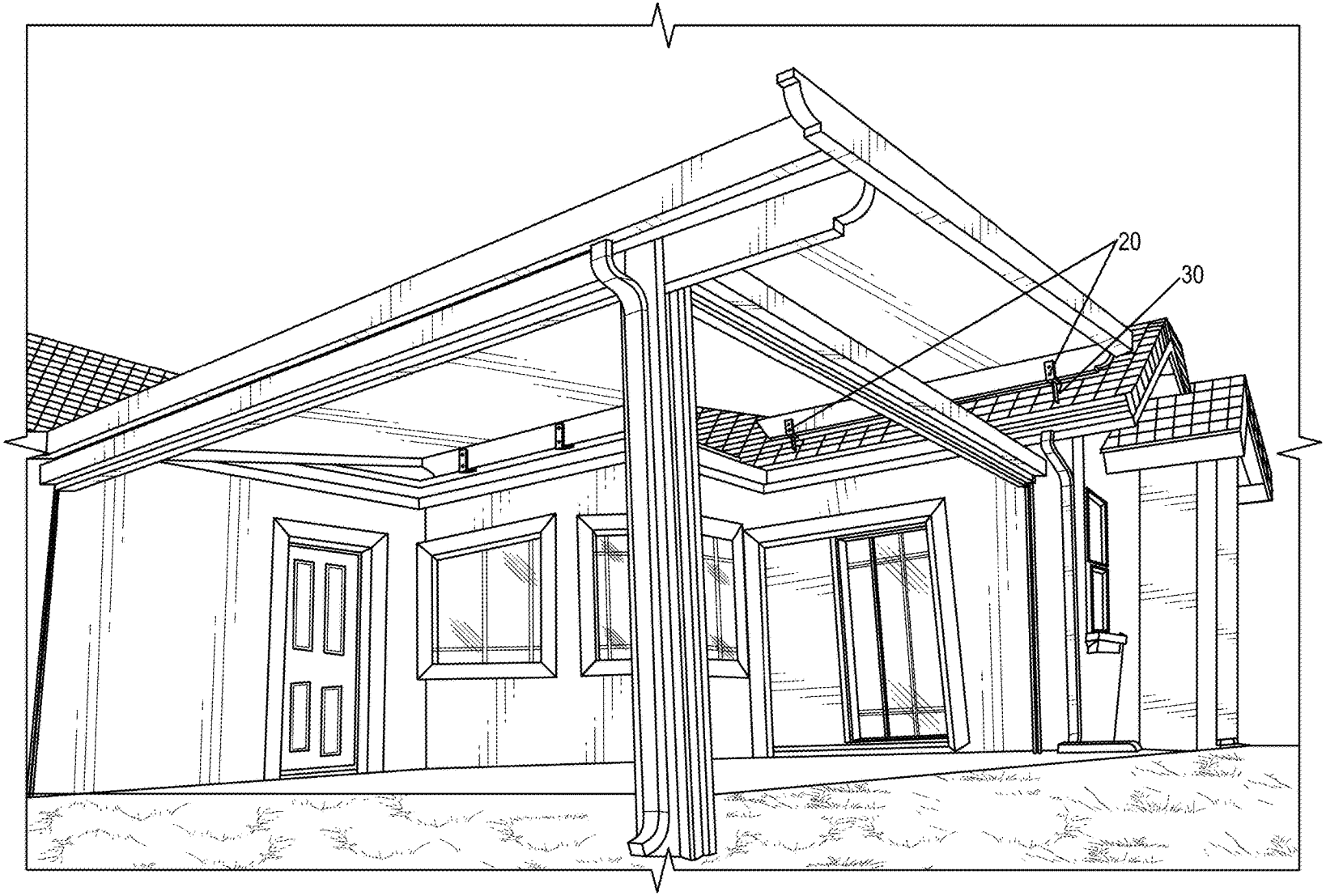
FIG. 6 is a photograph of a finished patio cover installed using high roof mounted brackets of the present invention.

FIG. 3 shows a high roof mount bracket of the present invention comprising beam seat or saddle 10, riser 20, and roof mounted plate 30. The roof mounted bracket can be produced in different models having different angles between riser 20 and roof mounted plate 30 corresponding to different standard roof pitches. FIG. 4 shows engineering drawings of an example of the high roof mounted bracket. As shown in FIGS. 3 and 5, the roof mounted bracket is installed under the roof material and is attached, preferably by screwing, to the roof substrate. In the case of the roofing material comprising shingles, the shingles can be lifted up to install the bracket; in the case of tiles, the tiles can be removed and then replaced after the brackets are installed. The bracket installation does not require any penetration through the roof substrate, thus minimizing the risk of roof leakage and/or damage. FIG. 6 is a photograph of a finished patio cover installed using roof mounted brackets of the present invention.

Figure 7:
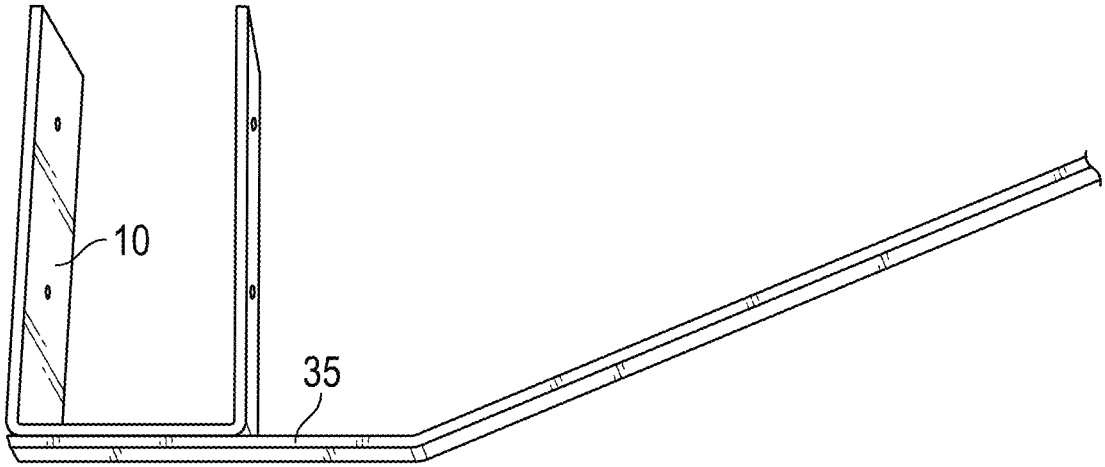
FIG. 7 shows a picture of a low roof mount bracket of the present invention.
Figure 8:
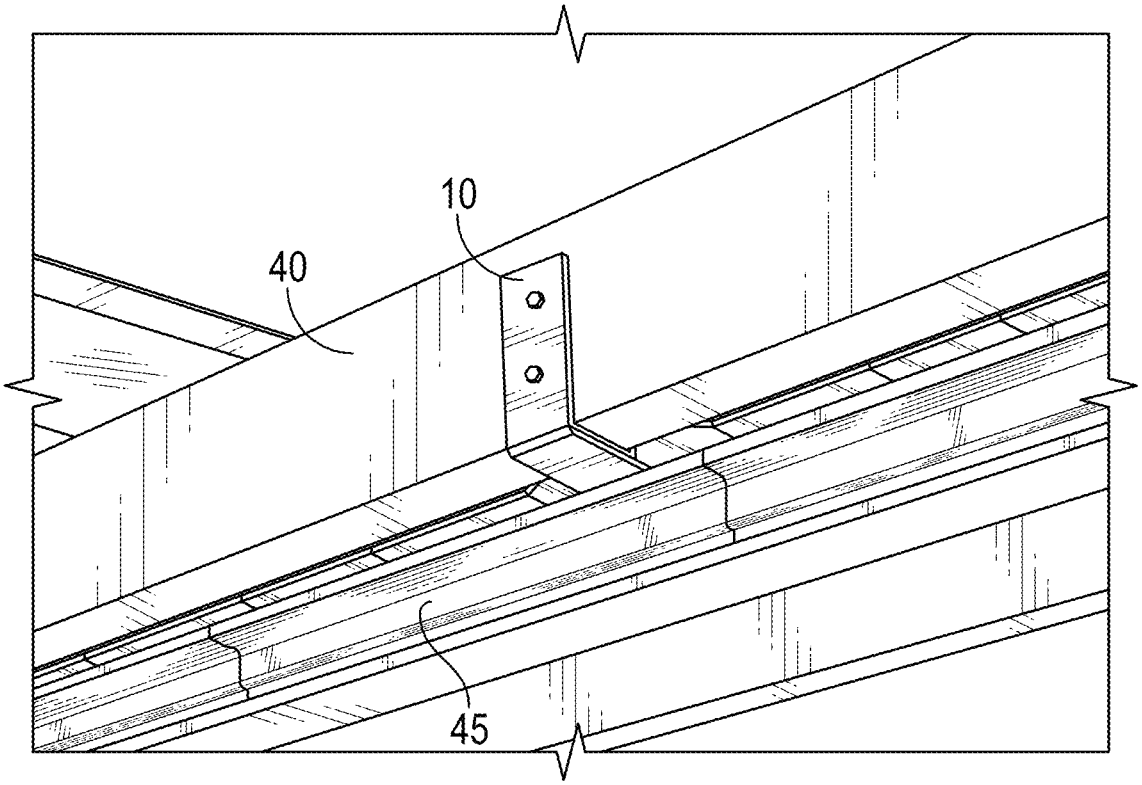
FIG. 8 shows a close up view of the low roof mount bracket as installed.
Figure 9:
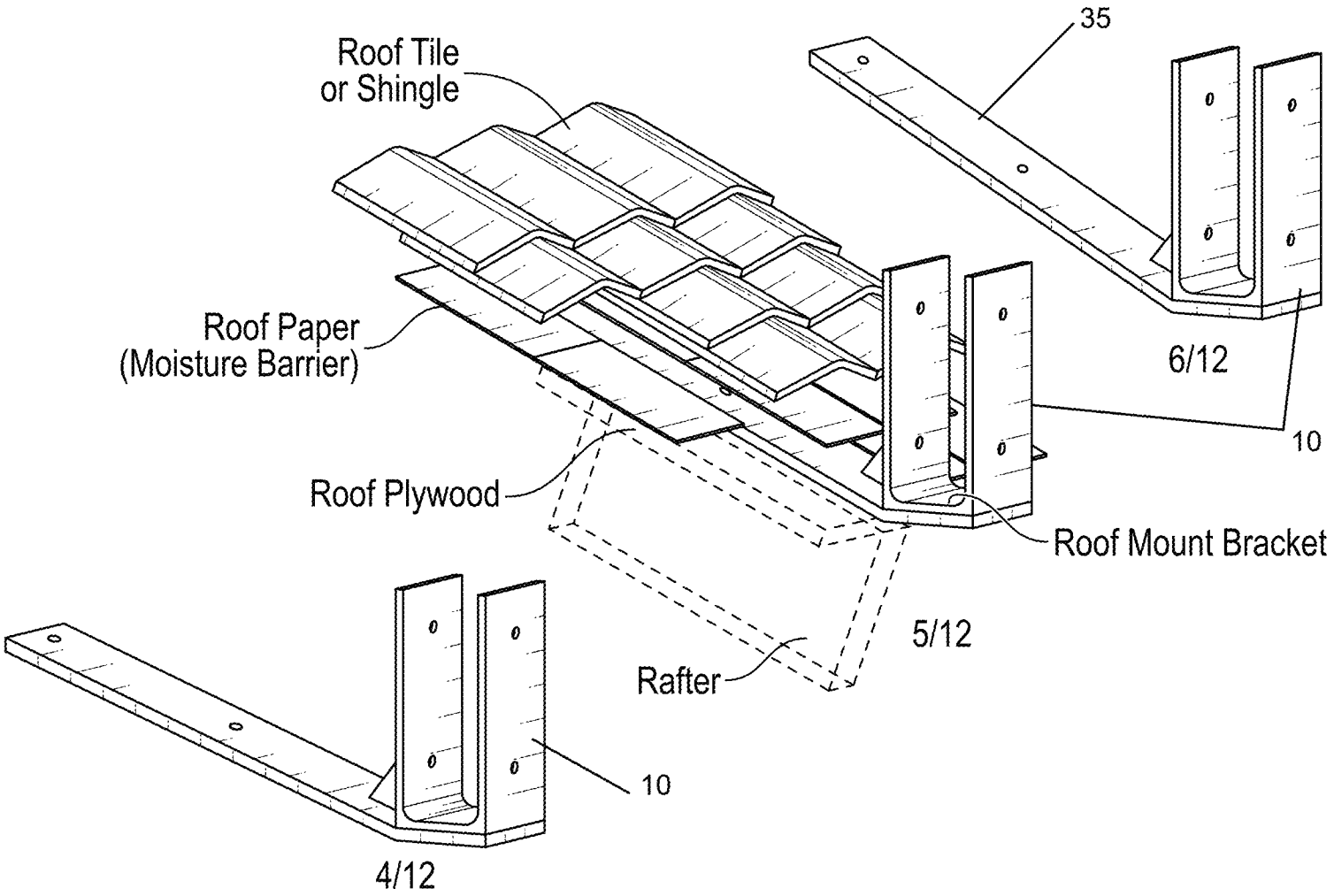
FIG. 9 shows two drawings of the low roof mount bracket with different pitches and one showing the plate installed under roof tiles or shingles.
Figure 10:
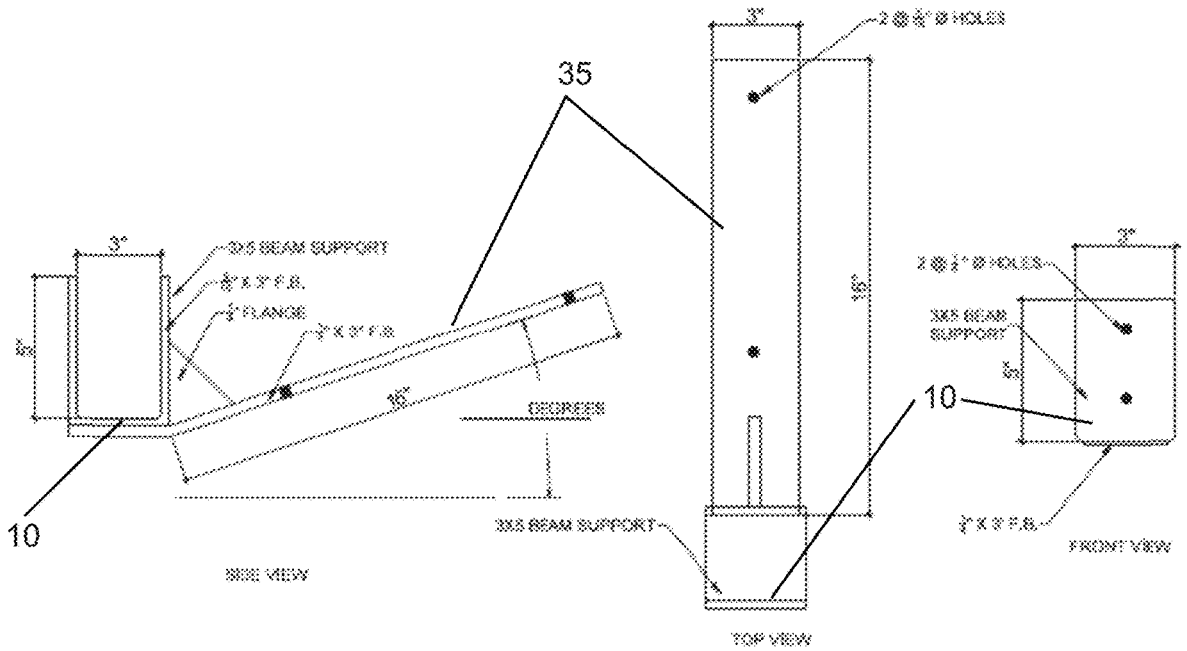
FIG. 10 shows engineering drawings of the low roof mount bracket of FIGS. 7-9.

FIG. 7 shows a picture of a low roof mount bracket, an alternative embodiment of a roof mount bracket of the present invention, comprising saddle 10 and roof mounted plate 35. This embodiment does not have a riser and is particularly useful for applications where the patio cover beam must be horizontally offset from the edge of the roof. FIG. 8 shows a close up view of saddle 10 holding patio cover beam 40, and shows that installation can be performed without removal of rain gutter 45. FIG. 9 shows drawings of the low roof mount bracket embodiment having different pitches and showing the plate installed under roof tiles or shingles. FIG. 10 shows engineering drawings of an example of a low roof mount bracket.

Figure 11:
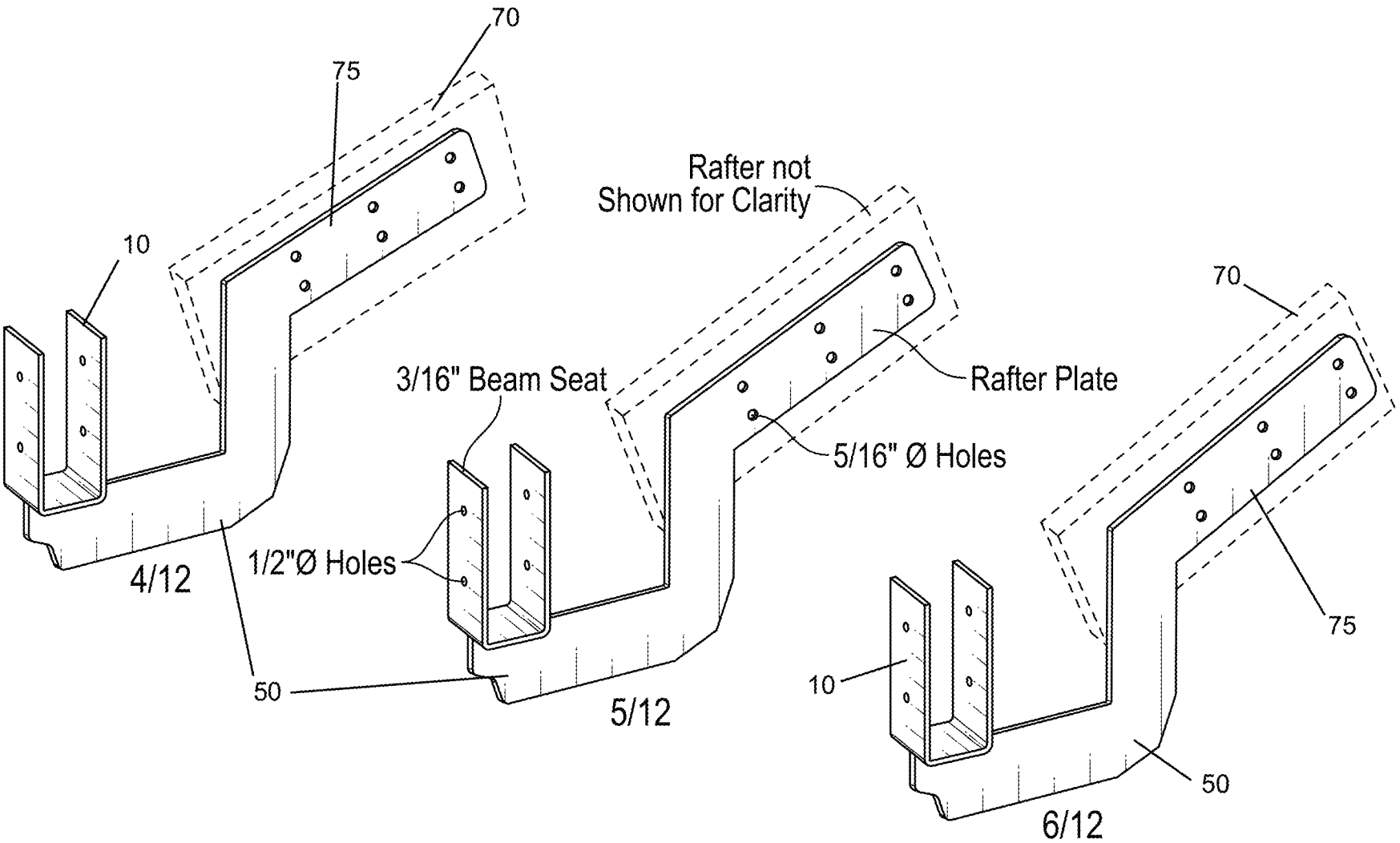
FIG. 11 shows three views of a rafter bracket of the present invention, each corresponding to a different roof pitch.
Figure 12:
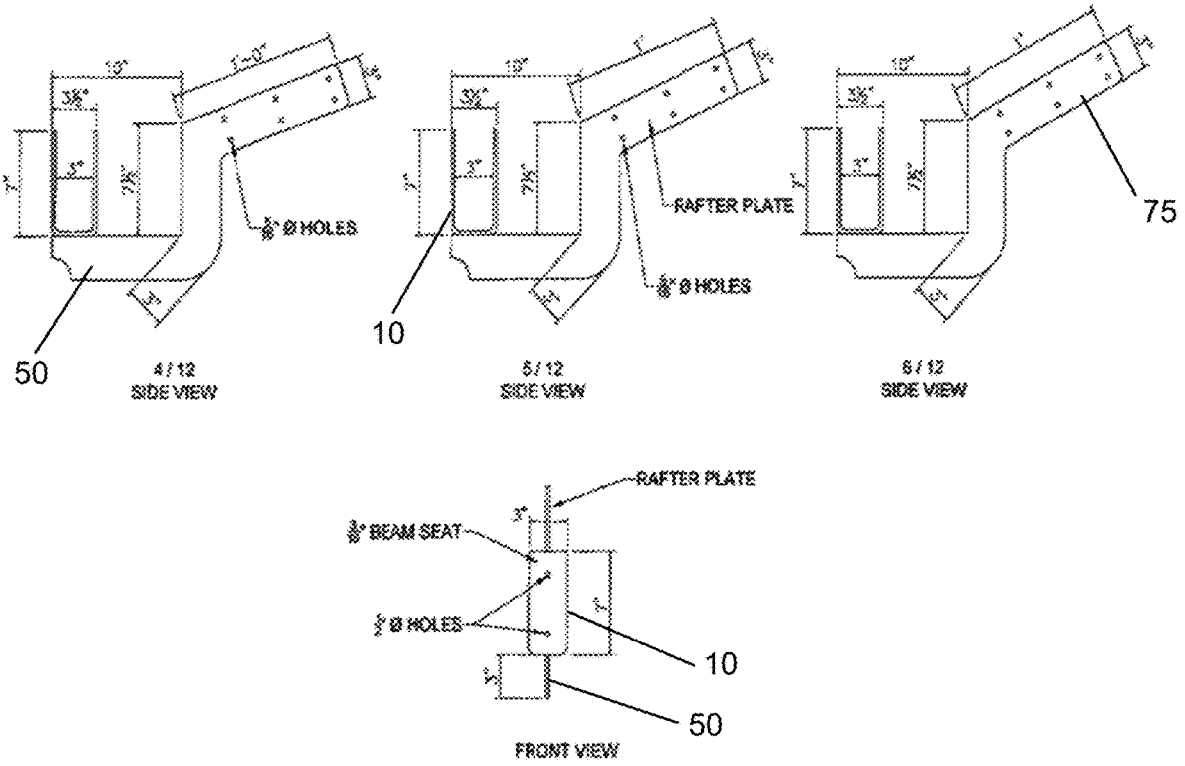
FIG. 12 shows engineering drawings of the rafter bracket of FIG. 11.
Figure 13:
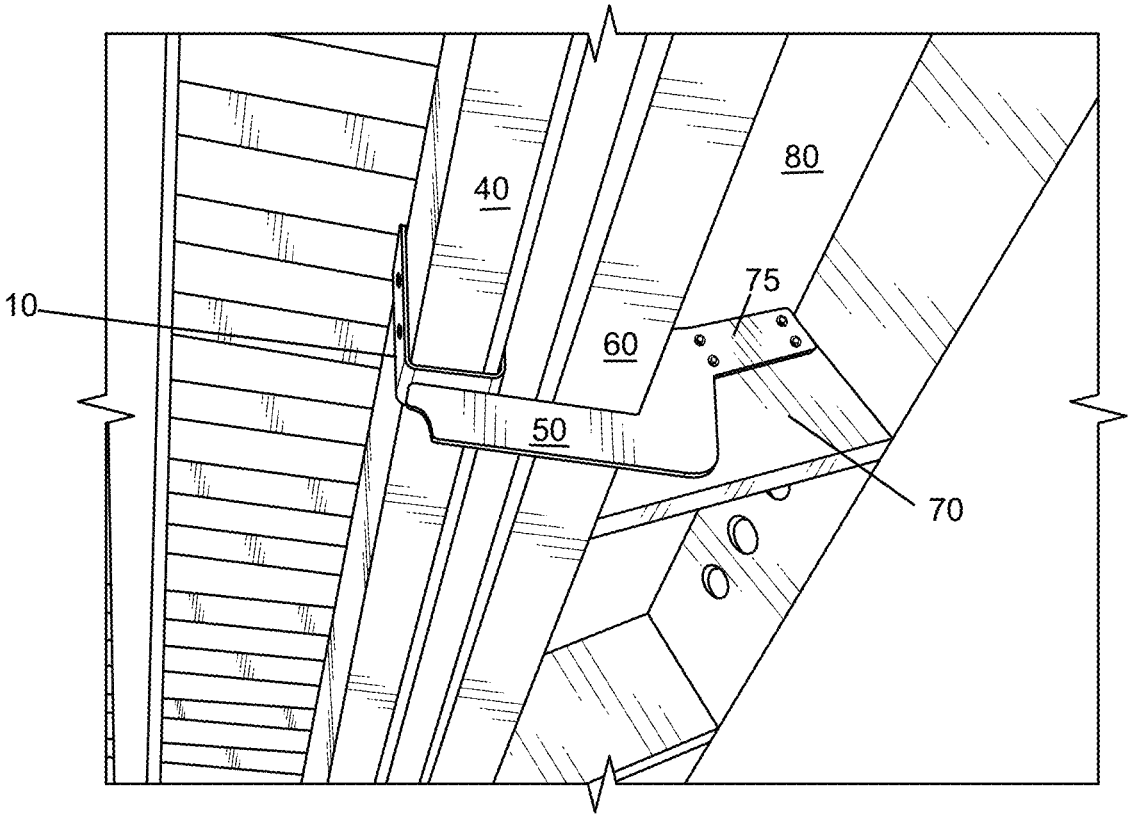
FIG. 13 shows the rafter bracket as installed.
Figure 14:
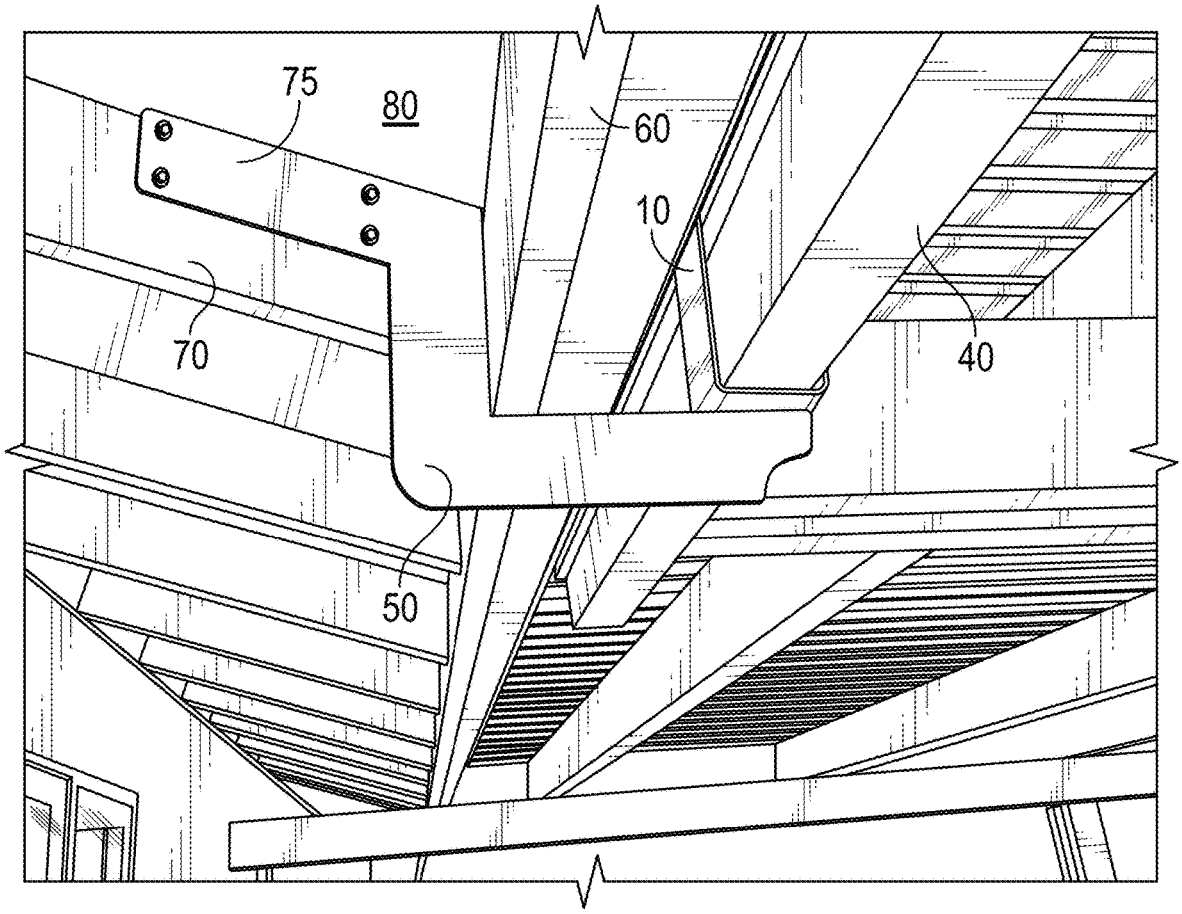
FIG. 14 is another view of the rafter bracket as installed.
Figure 15:
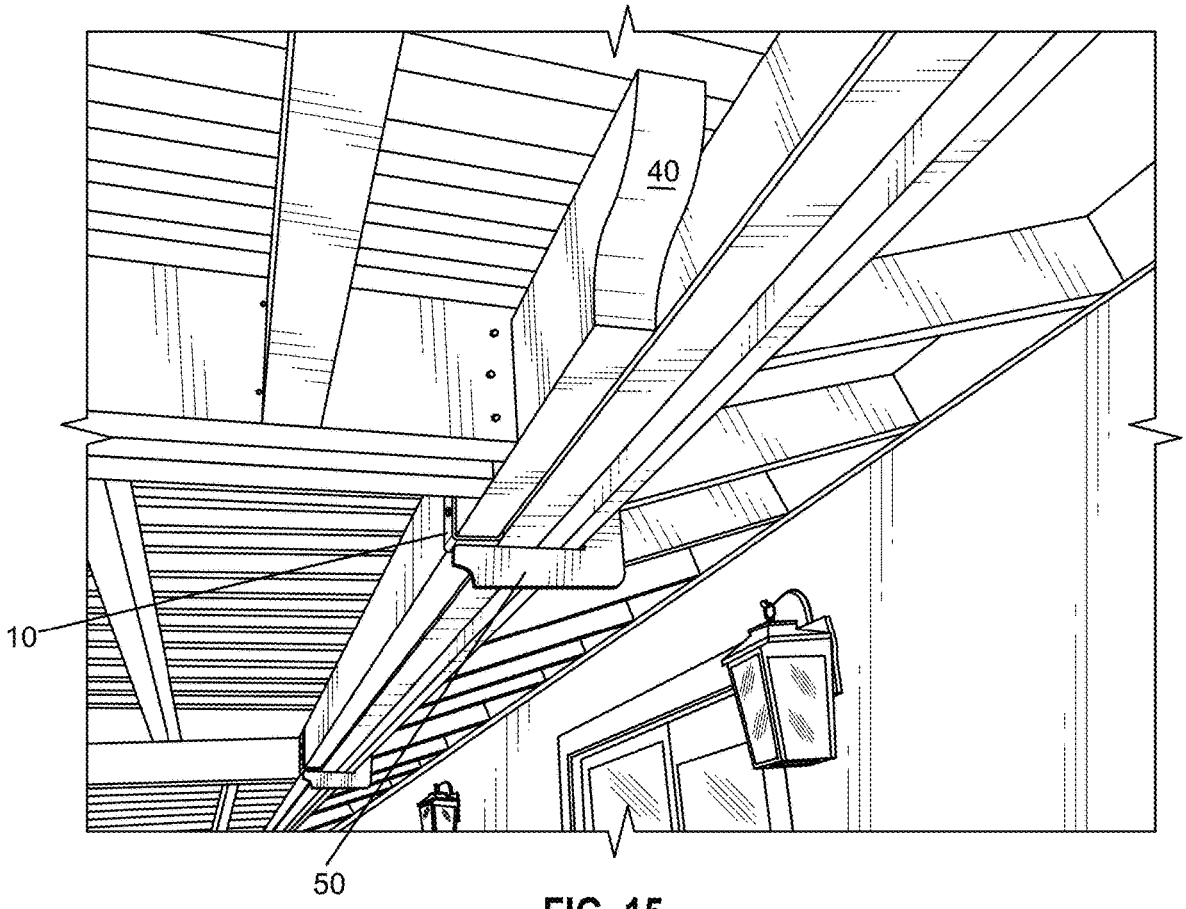
FIG. 15 is another view of the rafter bracket as installed.
Figure 16:
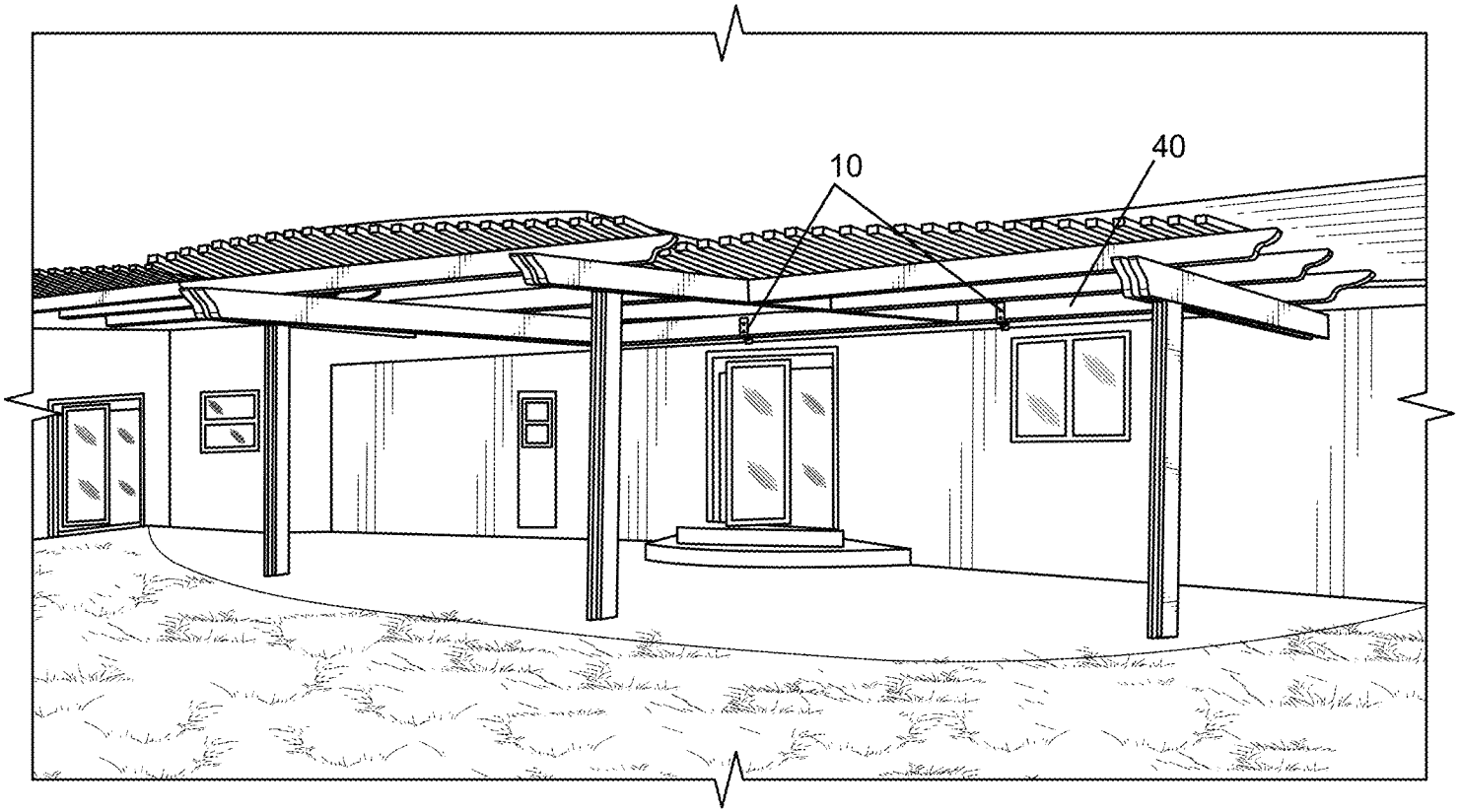
FIG. 16 is a photograph of a finished patio cover installed using rafter brackets of the present invention.
Figure 17A:
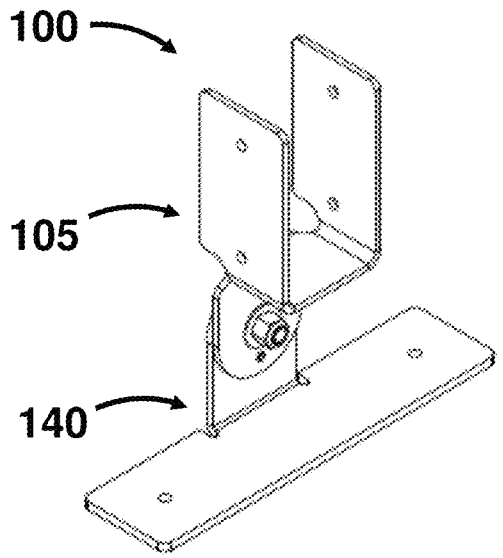
FIG. 17A is a perspective front drawing of an embodiment of an adjustable high roof mount bracket of the present invention.
Figure 17B:
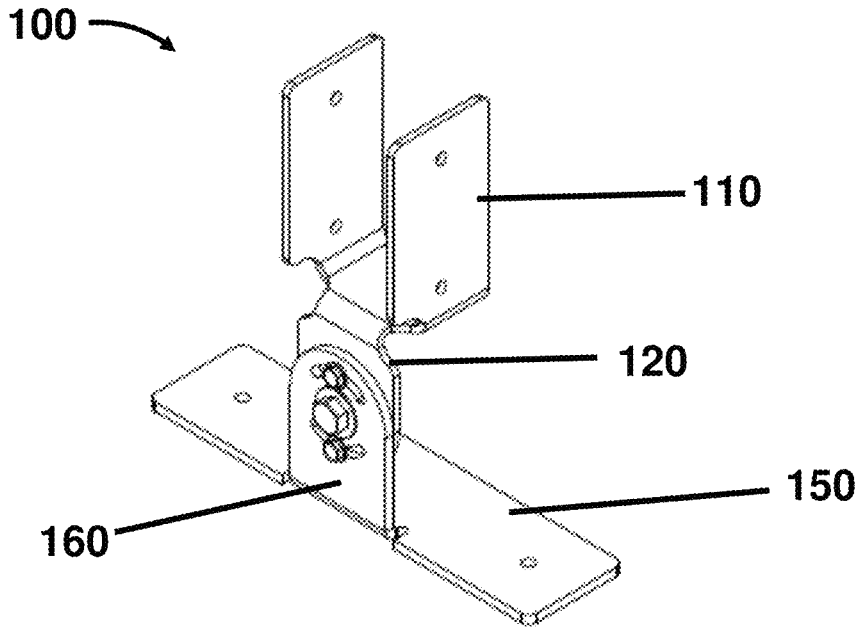
FIG. 17B is a perspective rear drawing of the adjustable high roof mount bracket of FIG. 17A.
Figure 17C:
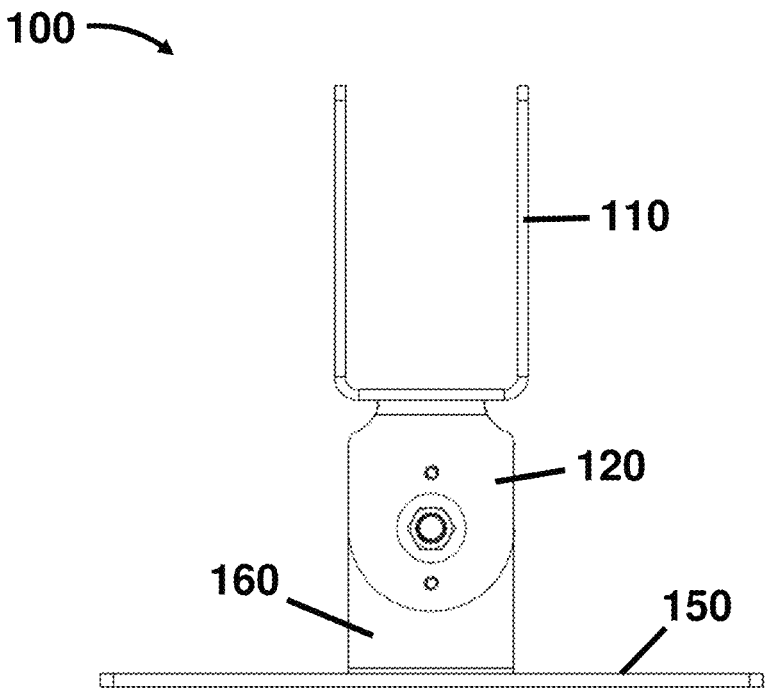
FIG. 17C shows a side view of the adjustable high roof mount bracket of FIG. 17A.
Figure 17D:
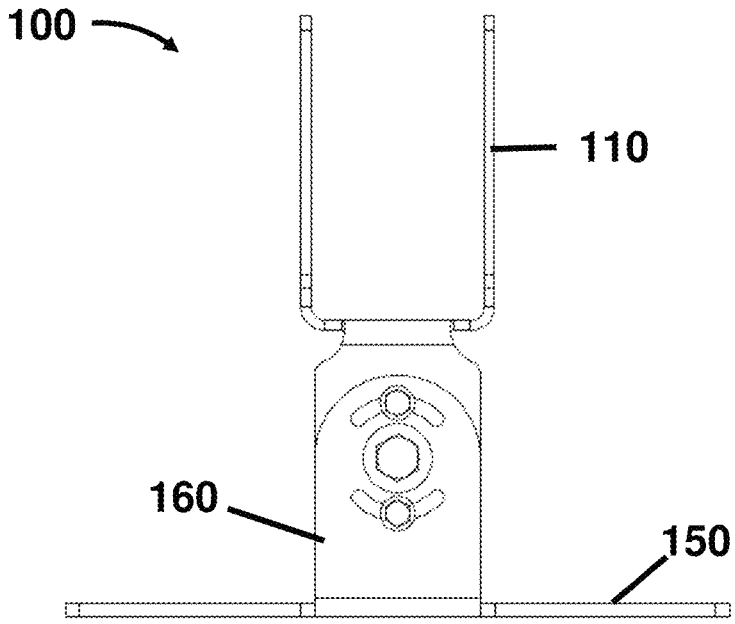
FIG. 17D shows an opposite side view of the adjustable high roof mount bracket of FIG. 17A.
Figure 17E:
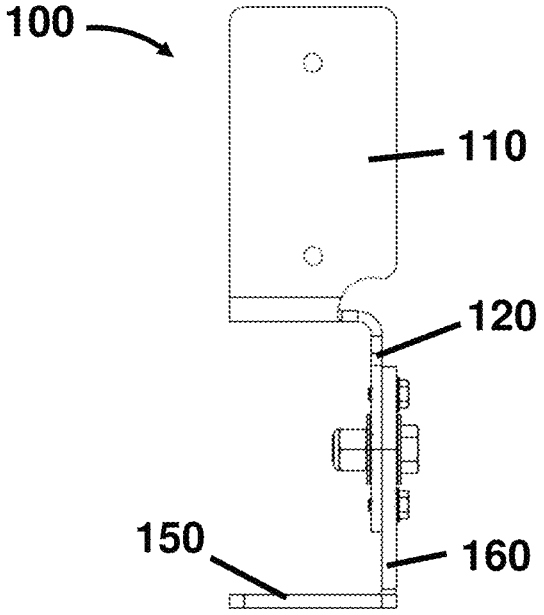
FIG. 17E shows a front view of the adjustable high roof mount bracket of FIG. 17A.
Figure 17F:
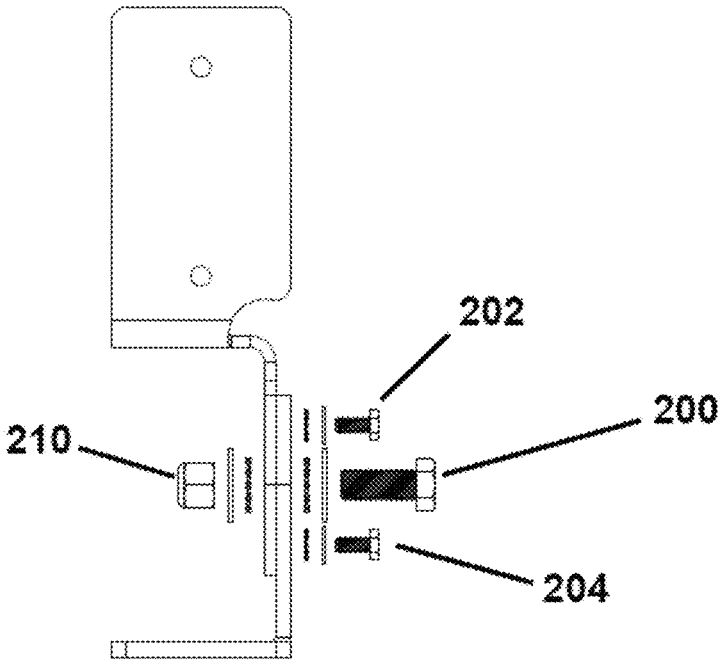
FIG. 17F shows an exploded front view of the adjustable high roof mount bracket of FIG. 17A.

FIG. 11 shows three views of rafter brackets of the present invention, each corresponding to a different roof pitch. FIG. 12 shows corresponding engineering drawings of the rafter brackets. As shown in FIGS. 13-15, base plate 50 preferably extends from saddle 10 under fascia 60 of the building and angles upward to enable rafter plate portion 75 to attach to rafter 70. Because base plate 50 is preferably available in all roof pitches, the top of rafter plate portion 75 preferably rests directly against underside 80 of the roof, enabling easy and fast installation so that saddle 10 is substantially automatically vertically oriented as installed, without requiring leveling. This installation eliminates any risk of roof leakage or damage. This bracket can be installed through a slot cut in a soffit if one is present. FIG. 16 is a photograph of a finished patio cover installed using rafter brackets of the present invention.

The user can choose to use roof mounted brackets or rafter brackets, depending on the desired mounting height and roof construction. The desired bracket is attached to the roof substrate or roof rafter (respectively) preferably using 4-Simpson SDS style screws. Next the user simply installs the 3"×8" patio cover support beam into the saddle (beam seat), affixes it with screws and is ready to finish typical patio cover installation.

Adjustable Brackets

In many cases a roof does not have a standard pitch, whether by design or due to inaccurate installation. Thus it may be difficult to install one of the brackets described above, since they are designed to manufactured corresponding to standard roof pitches. Therefore it is advantageous for the brackets to be available in adjustable versions for which the pitch can be adjusted by the installer to exactly match the roof pitch. During installation the base of the bracket is preferably attached (e.g. bolted) to the roof substrate or rafter, as the case may be, and then the installer tilts the saddle until, as preferably determined by a level, the bottom of the saddle is horizontal. The adjustable versions are preferably marked with common roof pitch indications to speed up installation on roofs with accurate standard pitches. Because the support beam extends across and is supported by multiple brackets, the beam ties those brackets together. And since in typical applications the beam is attached to a structure comprising posts embedded in concrete (or otherwise securely attached to or sunk into the ground), possible loosening of one or more of the brackets will not weaken the structure.

Figure 18A:
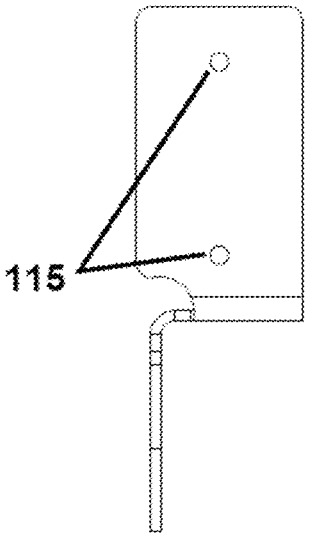
FIG. 18A shows a front view of the saddle part of the adjustable high roof mount bracket of FIG. 17A.
Figure 18B:
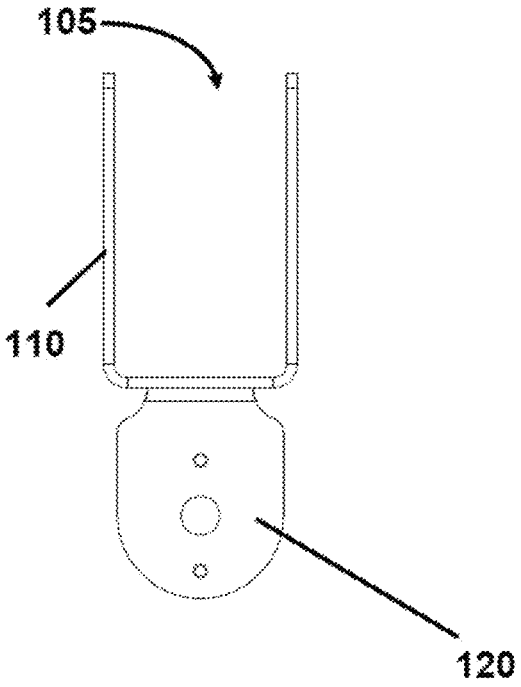
FIG. 18B shows a side view of the saddle part of FIG. 18A.
Figure 18C:
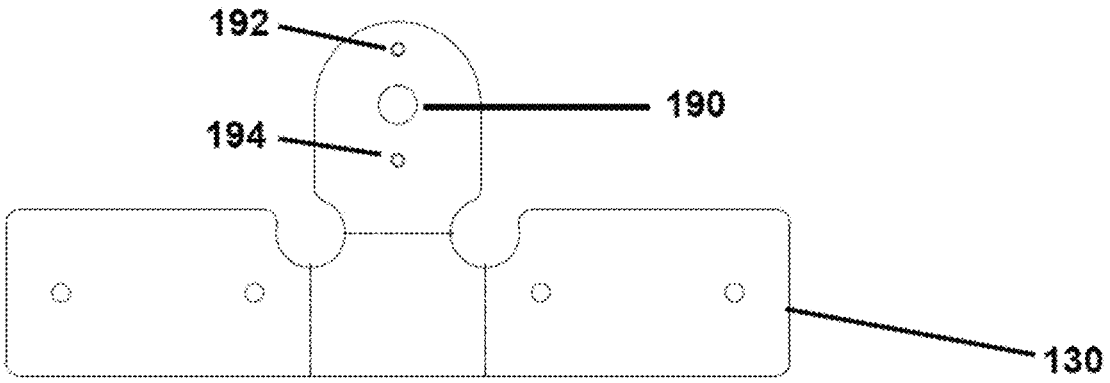
FIG. 18C shows the flat sheet used to form the saddle part of FIG. 18A.
Figure 19A:
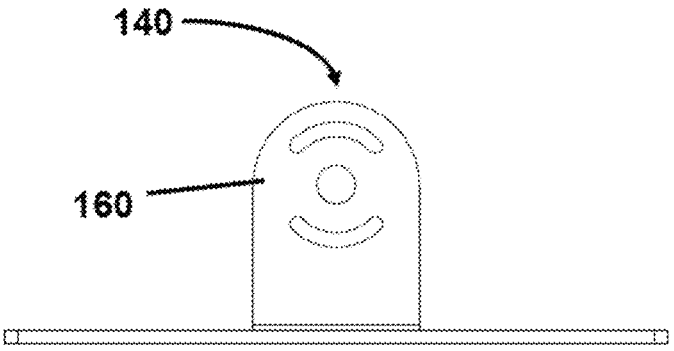
FIG. 19A shows a side view of the base of the adjustable high roof mount bracket of FIG. 17A.
Figure 19B:
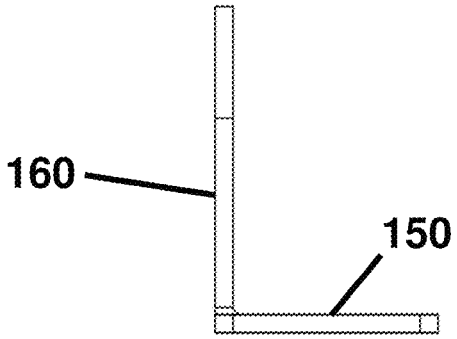
FIG. 19B shows a front view of the base of FIG. 19A.
Figure 19C:
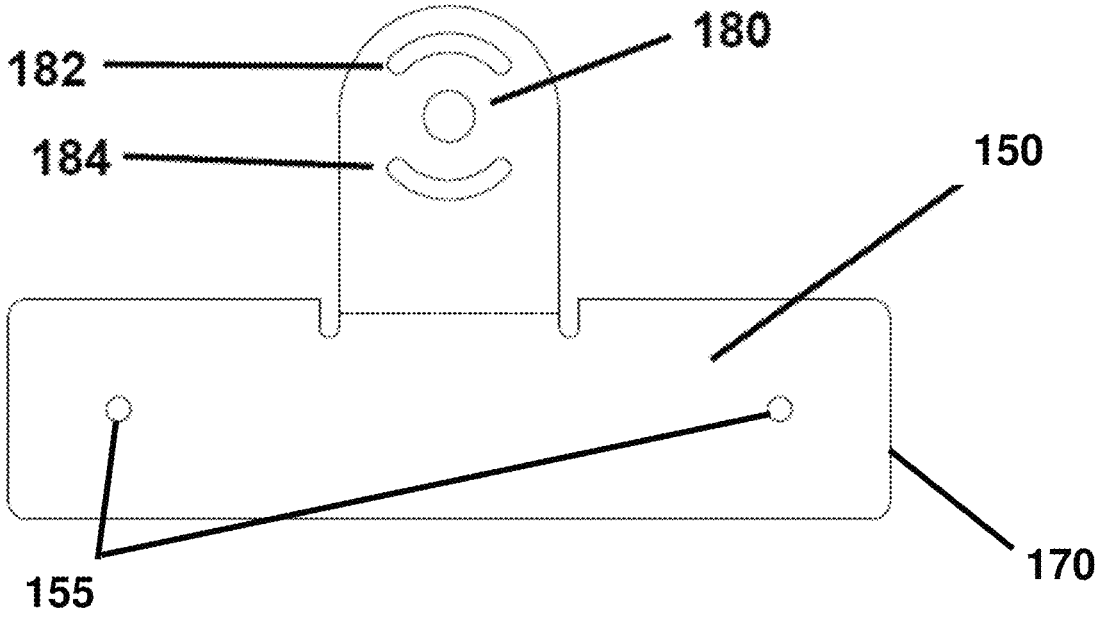
FIG. 19C shows the flat sheet used to form the base of FIG. 19A.
Figure 20A:
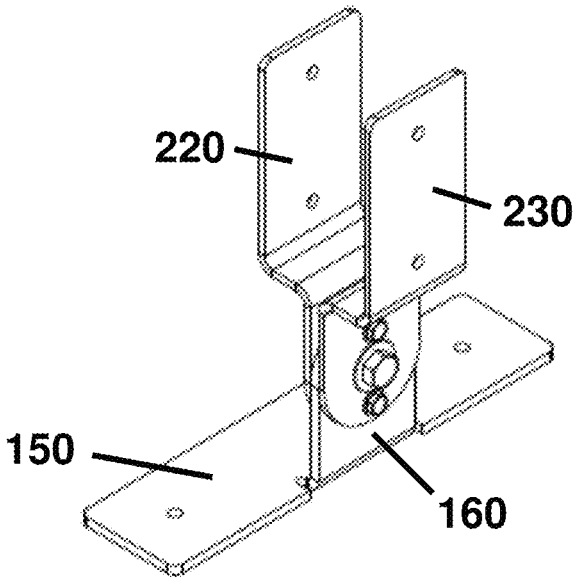
FIG. 20A is a perspective front drawing of another embodiment of an adjustable high roof mount bracket of the present invention.
Figure 20B:
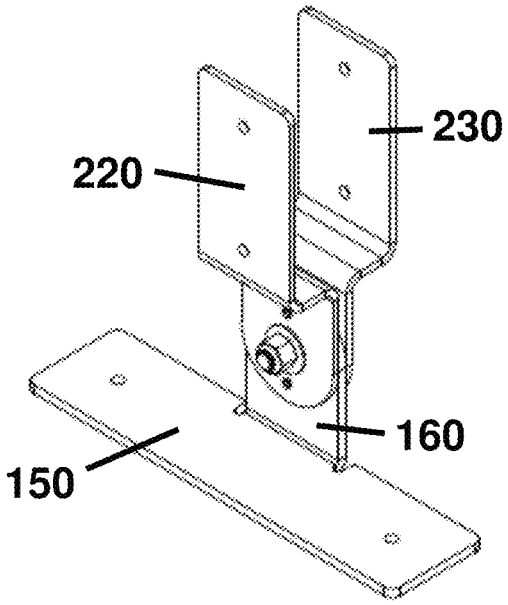
FIG. 20B is a perspective rear drawing of the adjustable high roof mount bracket of FIG. 20A.
Figure 20C:
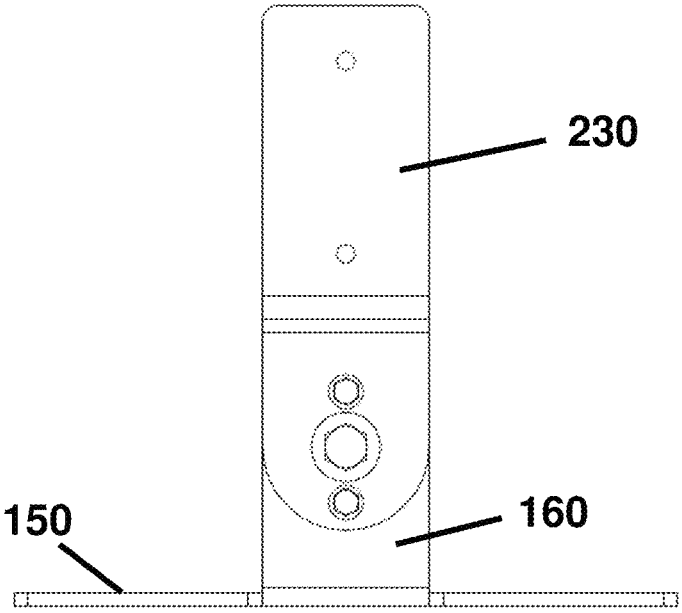
FIG. 20C shows a side view of the adjustable high roof mount bracket of FIG. 20A.
Figure 20D:
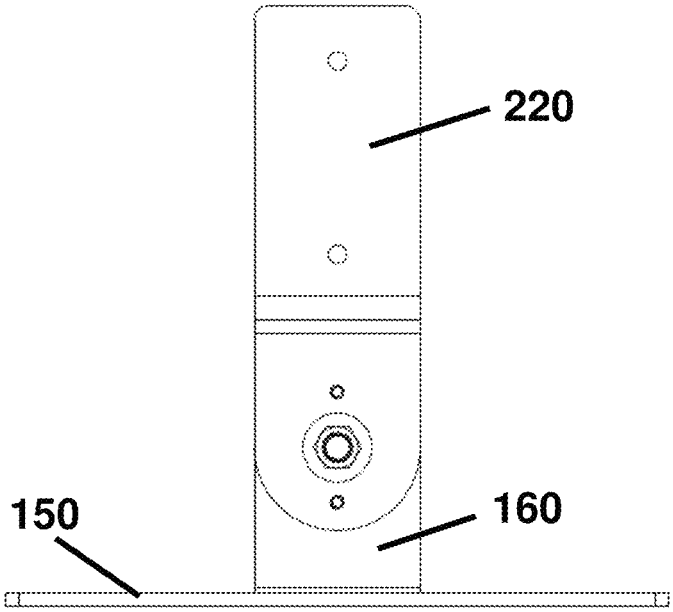
FIG. 20D shows a side view of the adjustable high roof mount bracket of FIG. 20A.
Figure 20E:
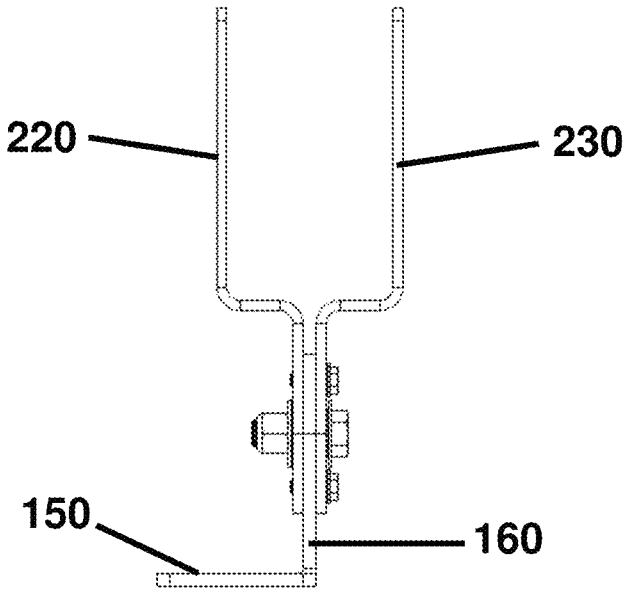
FIG. 20E shows a front view of the adjustable high roof mount bracket of FIG. 20A.
Figure 20F:
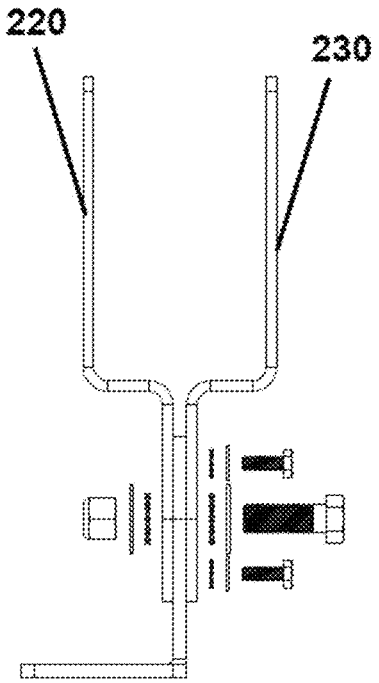
FIG. 20F shows an exploded front view of the adjustable high roof mount bracket of FIG. 20A.
Figure 21A:
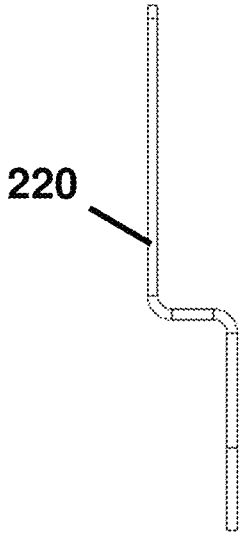
FIG. 21A shows a left saddle half of the adjustable high roof mount bracket of FIG. 20A.
Figure 21B:
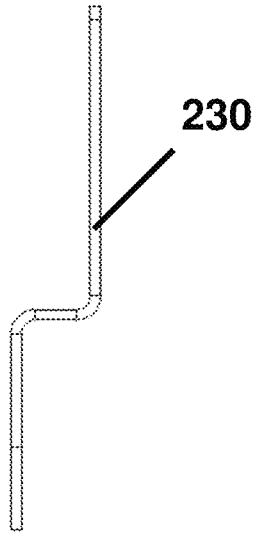
FIG. 21B shows a right saddle half of the adjustable high roof mount bracket of FIG. 20A.
Figure 21C:
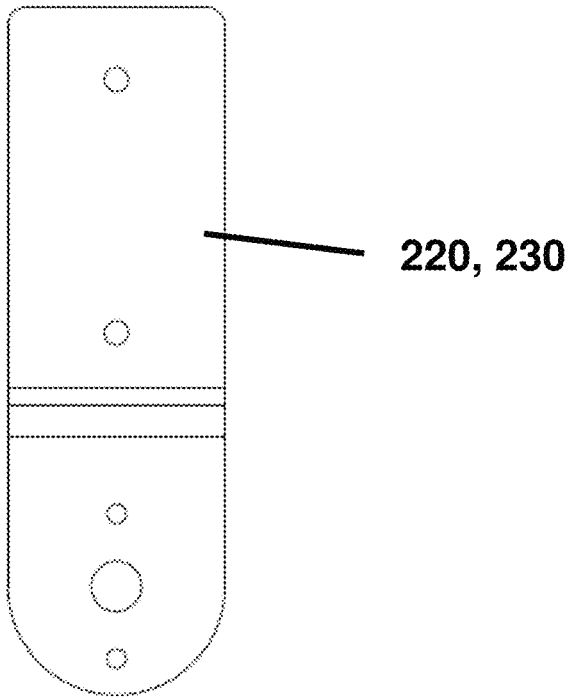
FIG. 21C shows a side view of a saddle half of the adjustable high roof mount bracket of FIG. 20A.
Figure 21D:
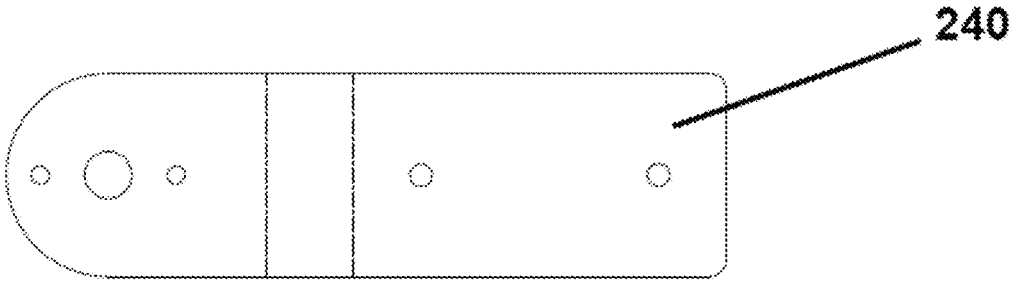
FIG. 21D shows the flat sheet used to form a saddle half of the adjustable high roof mount bracket of FIG. 20A.

FIGS. 17-21 show two embodiments of an adjustable version of the high or raised roof mount bracket shown in FIGS. 3-6. A first embodiment, shown in FIGS. 17-19, is adjustable raised roof mount bracket assembly 100 preferably comprising saddle part 105 and base 140. Saddle part 105 preferably comprises saddle 110, which is preferably about 5½" high and whose sides are about 3⅛" apart, and saddle connection portion 120, which is preferably about 3" wide and about 4" high, and is preferably formed from flat sheet metal or steel part 130, preferably comprising ¼" steel, for ease of manufacturing. Saddle 110 preferably comprises one or more openings 115 for enabling a support beam inserted in saddle 110 to be secured to saddle 110 via nails, screws, or other fasteners inserted through openings 115. Base 140 preferably comprises base plate 150 and base connection portion 160 and is preferably formed from flat sheet metal part 170, which preferably comprises ¼" steel. Base plate 150 is preferably about 12"×3" in size. Base connection portion 160 preferably is about 4" to 4⅜" high and about 3" wide. Base plate 150 preferably comprises a plurality of openings 155 for receiving screws, nails, or other fasteners to attach adjustable raised roof bracket assembly 100 to the roof substrate.

Saddle connection portion 120 of saddle part 105 is preferably rotatably attachable to base connection portion 160 of base 140. Base connection portion 160 preferably comprises three openings: base pivot opening 180 and curved slots 182, 184. Saddle connection portion 120 preferably comprises saddle pivot opening 190 in addition to holes 192, 194 (which are preferably tapped). In alternative embodiments the saddle connection portion may comprise one or both of the slots instead of, or in addition to, one or both of the slots on the base connection portion. Pivot bolt 200, which is preferably at least partially threaded, is preferably inserted through base pivot opening 180 and saddle pivot opening 190, enabling relative pivoting of saddle part 105 and base 140. During installation, after the attachment of base plate 150 to the roof substrate, saddle part 105 is rotated until the sides of saddle 110 are vertical, preferably determined via use of a level. Pivot bolt 200 is then preferably secured by lock nut 210 and one or more corrugated washers, or by an alternative locking mechanism such as a lock washer. Set bolt 202 is inserted through slot 182 and threaded into tapped hole 192, and set bolt 204 is inserted through slot 184 and threaded into tapped hole 194. Set bolts 202, 204 are preferably secured by corrugated washers, or by an alternative locking mechanism such as lock washers. Set bolts 202, 204 are preferably ¼-20 bolts, and tapped holes 192, 194 preferably comprise ¼-20 threads.

The base and saddle part of the adjustable raised roof mount bracket assembly may alternatively be formed by casting, or alternatively by welding the saddle to the saddle connection portion and/or welding the base plate to the base connection portion.

In the first embodiment of the adjustable raised roof bracket assembly described above, the center of saddle 110 is offset from the vertical base connection portion 160. In the second embodiment of the adjustable raised roof bracket assembly, shown in FIGS. 20-21, after assembly the saddle is centered over the base connection portion. In this embodiment the saddle comprises two saddle halves 220, 230 which are each rotatably attachable to the base connection portion of base 140 in a similar manner to saddle 110 of the previous embodiment, and installation is similar. Saddle halves 220, 230 are each preferably formed from flat sheet metal or piece 240. In this embodiment the set bolts are preferably ½-20 bolts and the tapped holes preferably comprise ½-20 threads. Each saddle half is about 9½" high, 3" wide, and about 1⅝" deep.

Figure 22A:
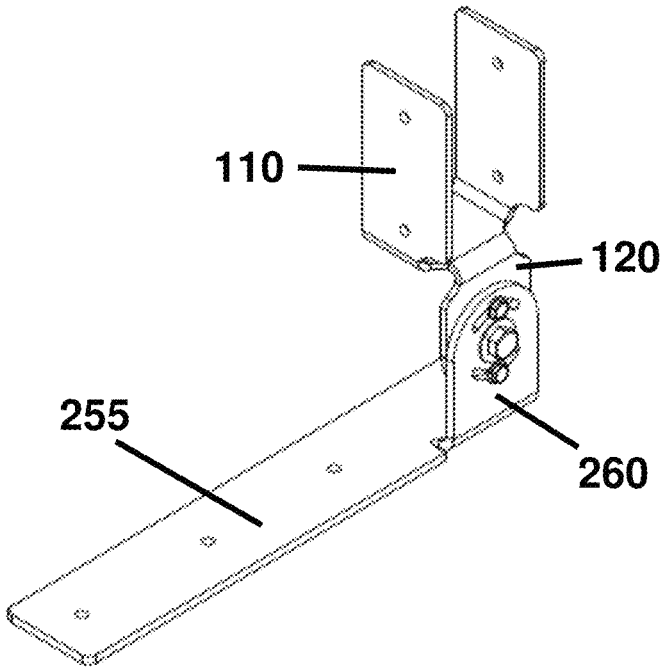
FIG. 22A is a perspective view of an adjustable low roof mount bracket of the present invention.
Figure 22B:
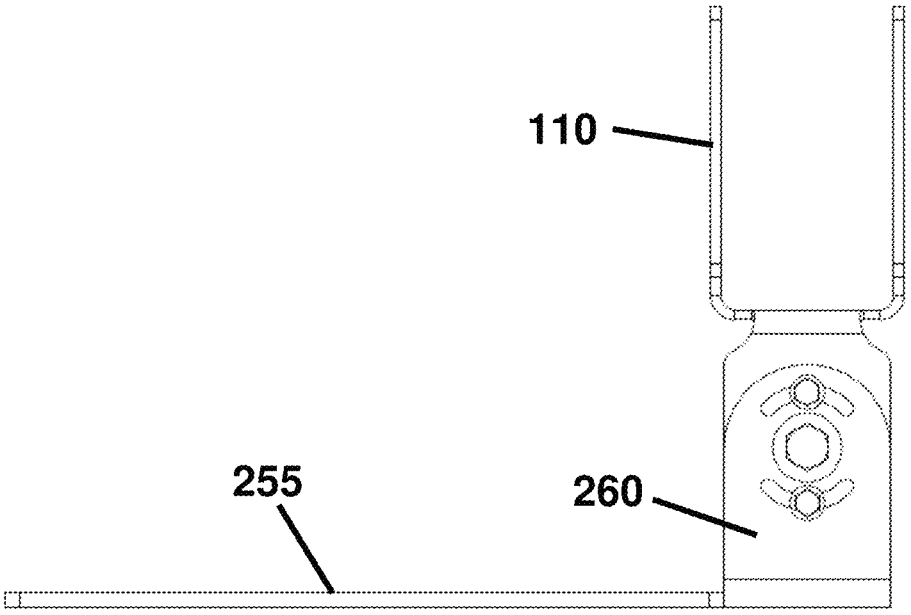
FIG. 22B is a side view of the adjustable low roof mount bracket of FIG. 22A.
Figure 23A:
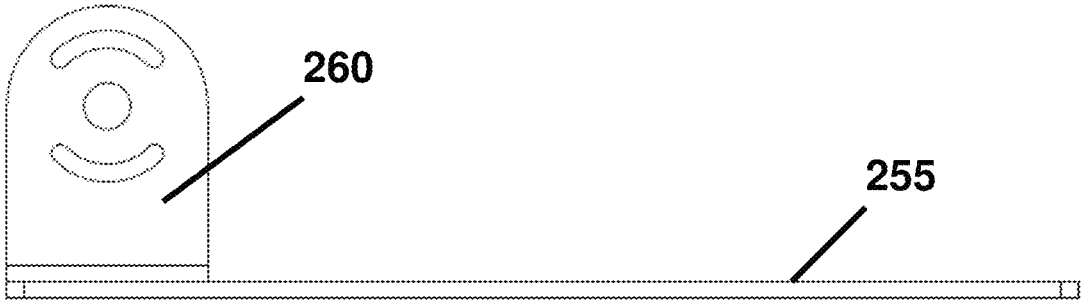
FIG. 23A is a side view of the base of the adjustable low roof mount bracket of FIG. 23A.
Figure 23B:
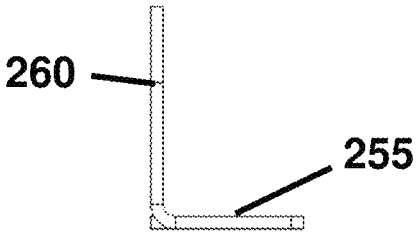
FIG. 23B is a front view of the base of FIG. 23A.
Figure 23C:
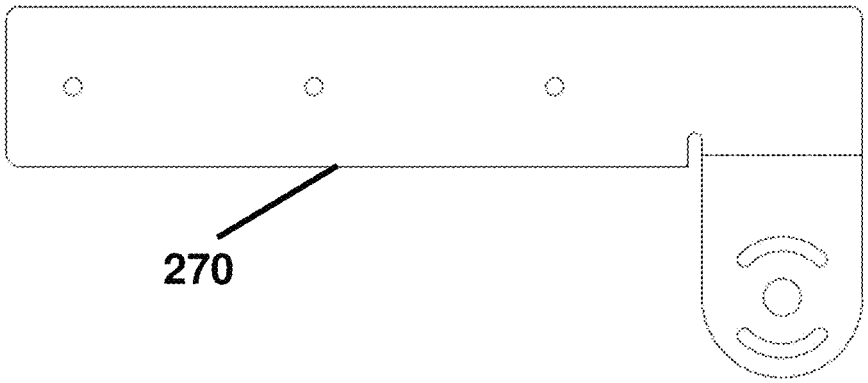
FIG. 23C shows the flat sheet used to form the base of FIG. 23A.
Figure 24A:
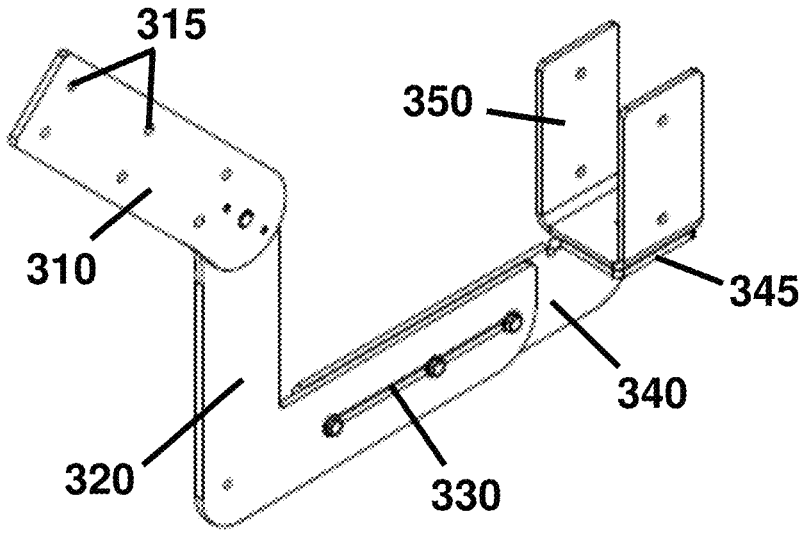
FIG. 24A is a perspective rear drawing of an embodiment of an adjustable rafter bracket of the present invention.
Figure 24B:
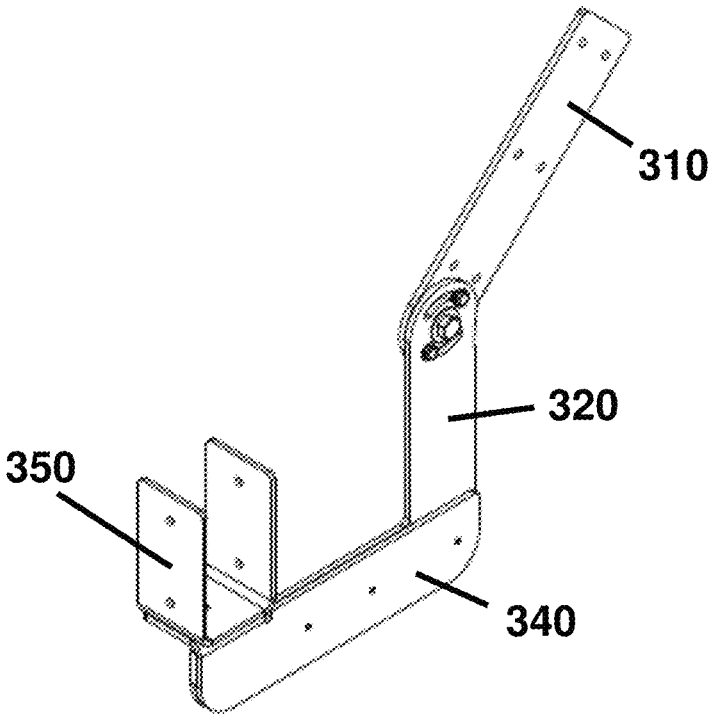
FIG. 24B is a perspective front drawing of the adjustable rafter bracket of FIG. 24A.
Figure 24C:
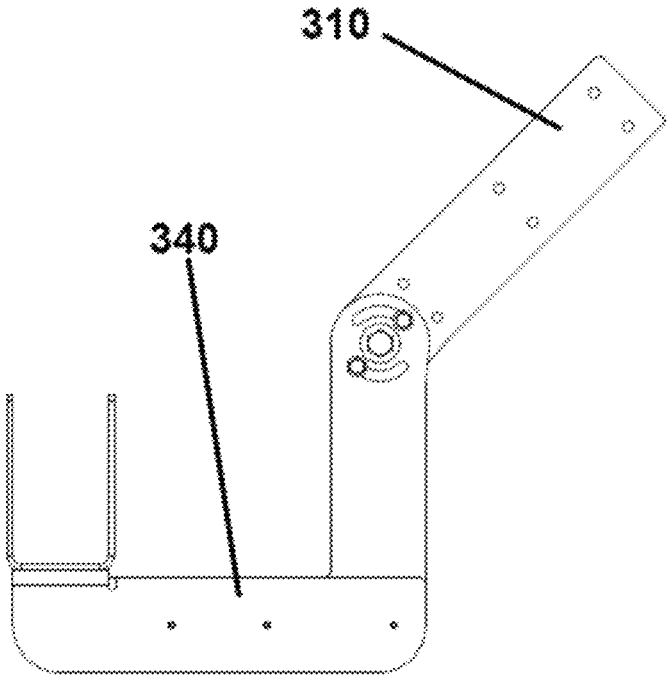
FIG. 24C shows a side view of the adjustable rafter bracket of FIG. 24A.
Figure 24D:
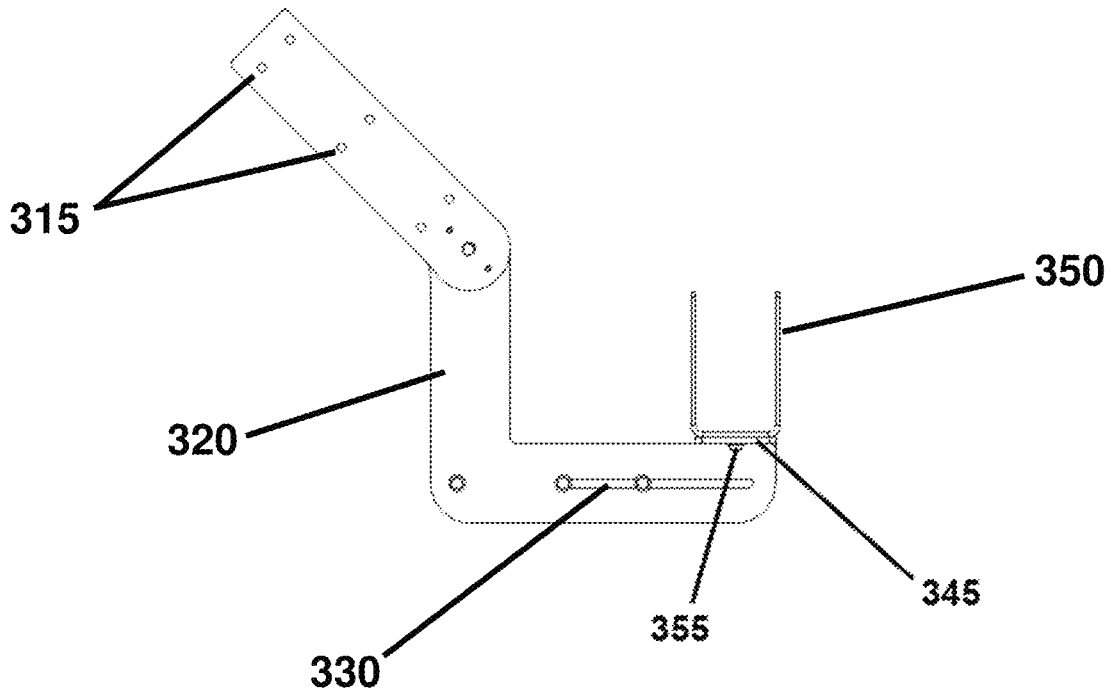
FIG. 24D shows another side view of the adjustable rafter bracket of FIG. 24A.
Figure 24E:
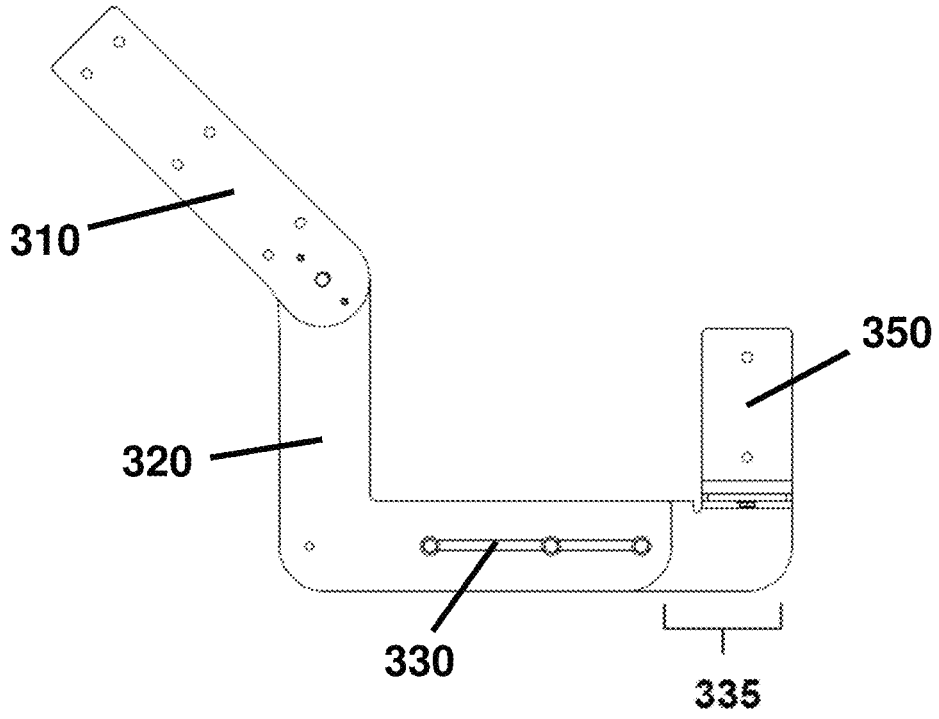
FIG. 24E is a side view of the adjustable rafter bracket of FIG. 24A showing the sliding extension of the saddle support.

An adjustable version of the low or flush mount roof bracket of FIGS. 7-10 is shown in FIGS. 22-23. The adjustable flush mount roof bracket assembly is operationally similar to the embodiments of the adjustable raised roof mount bracket assembly described above, except that the base connection portion 260 is located at the end of a preferably longer base plate 255, which is preferably about 16"×3" in size and comprises ¼" steel, both of which are preferably formed from a single flat sheet metal or steel part 270. The saddle of this bracket may optionally be split into two saddle halves, similar to the embodiment shown in FIGS. 20-21.

An adjustable version of the rafter bracket shown in FIGS. 11-15 is shown in FIG. 24. The adjustable rafter bracket assembly preferably comprises rafter plate 310, which is preferably rotatably attachable to L-bracket 320 in a similar manner to the embodiments described above. Rafter plate 310 preferably comprises a plurality of openings 315 for receiving screws, nails, or other fasteners to attach the adjustable rafter bracket assembly to the rafter. After attachment, L-bracket 320 is then rotated so that its components are vertically and horizontally oriented. L-bracket 320 preferably comprises slot 330 for receiving one or more bolts to slideably attach it to saddle support 340. Saddle support 340 can be extended outwardly (indicated at 335) by an installer if needed (for example to extend beyond the gutter) by sliding it relative to L-bracket 320. Saddle support 340 preferably comprises flange 345 to which saddle 350 is attached via bolt 355. This attachment method enables saddle 350 to be rotated to hold a support beam oriented at angle to the plane of the bracket as required, including but not limited to, perpendicularly (as shown in FIGS. 13-14). In this embodiment saddle support 340 and flange 345 are preferably formed from a single flat sheet metal piece. Alternatively, if only one orientation of saddle 350 is desired, saddle 350 and saddle support 340 may together be formed from a single flat sheet metal piece, with the bottom of saddle 350 taking the place of flange 345.

Note that in the specification and claims, "about" or "approximately" means within twenty percent (20%) of the numerical amount cited. As used herein, the singular forms "a," "an," and "the" include plural referents unless the context clearly dictates otherwise. Thus, for example, reference to "a functional group" refers to one or more functional groups, and reference to "the method" includes reference to equivalent steps and methods that would be understood and appreciated by those skilled in the art, and so forth.

Although the invention has been described in detail with particular reference to the disclosed embodiments, other embodiments can achieve the same results. Variations and modifications of the present invention will be obvious to those skilled in the art and it is intended to cover all such modifications and equivalents. The entire disclosures of all patents and publications cited above are hereby incorporated by reference.

What is claimed is:

1. A bracket assembly for attaching a structure to a roof of a building, the bracket assembly comprising:

a base component comprising a solid upright portion positioned perpendicular to a flat plate, the flat plate configured to be attached to the roof such that the flat plate is disposed between a roof substrate and a roof covering in an installed configuration, the solid upright portion configured to extend upward through the roof covering in the installed configuration; and a saddle component comprising a solid extension and a saddle opening configured to receive a support beam above the roof substrate to support the structure, said solid extension rotatably attached directly to said solid upright portion in the installed configuration;

wherein an angle between said base component and said saddle component is configured to be adjusted and said saddle opening is substantially vertically oriented in the installed configuration;

and wherein, in the installed configuration, said saddle opening is oriented such that the support beam is disposed in said saddle opening and the support beam is parallel to a roof edge.

2. The bracket assembly of claim 1 wherein the base component does not comprise a component for penetrating the roof substrate.

3. The bracket assembly of claim 1 wherein the structure comprises a patio cover, an architectural feature, a solar panel, a roof deck, a trellis, an arbor, or a walkway.

4. The bracket assembly of claim 1 wherein the roof covering comprises shingles or tiles.

5. The bracket assembly of claim 1 wherein said saddle component comprises two separate saddle halves, each saddle half comprising a connection extension and a bend, so that when said connection extensions of said two saddle halves are attached to opposite sides of said solid upright portion, said two saddle halves form said saddle opening.

6. The bracket assembly of claim 1 sufficiently load bearing so that only one bracket is needed along every eight feet of the support beam.

7. The bracket assembly of claim 1 wherein said saddle component is attachable at an end of said base component so that when said flat plate is attached to the roof said saddle component is disposed beyond an edge of the roof.

8. The bracket assembly of claim 1 wherein when said flat plate is attached to the roof said saddle component is disposed above a roof gutter.

9. The bracket assembly of claim 1 wherein said saddle component and said base component are each formed from a single metallic plate or sheet.

* * * * *